US008029120B2

(12) United States Patent
Wanibe

(10) Patent No.: US 8,029,120 B2
(45) Date of Patent: Oct. 4, 2011

(54) LIQUID CONTAINER AND METHOD OF MANUFACTURING THE SAME

(75) Inventor: Akihisa Wanibe, Matsumito (JP)

(73) Assignee: Seiko Epson Corporation, Tokyo (JP)

( * ) Notice: Subject to any disclaimer, the term of this patent is extended or adjusted under 35 U.S.C. 154(b) by 446 days.

(21) Appl. No.: 12/252,390

(22) Filed: Oct. 16, 2008

(65) Prior Publication Data

US 2009/0322840 A1 Dec. 31, 2009

(30) Foreign Application Priority Data

Oct. 16, 2007 (JP) ..... 2007-269355
Mar. 24, 2008 (JP) ..... 2008-075006
Mar. 24, 2008 (JP) ..... 2008-075549

(51) Int. Cl.
*B41J 2/19* (2006.01)
*B41J 2/175* (2006.01)
*B41J 2/195* (2006.01)

(52) U.S. Cl. ..... 347/92; 347/94; 347/7; 347/19; 347/86; 347/84

(58) Field of Classification Search ..... None
See application file for complete search history.

(56) References Cited

U.S. PATENT DOCUMENTS

| | | | | |
|---|---|---|---|---|
| 7,008,034 | B2 | 3/2006 | Tsukada et al. | |
| 7,552,999 | B2 | 6/2009 | Wanibe et al. | |
| 7,578,567 | B2 * | 8/2009 | Zhang et al. | 347/7 |
| 2006/0203053 | A1 | 9/2006 | Katsumura | |
| 2006/0227190 | A1 | 10/2006 | Ishizawa et al. | |

FOREIGN PATENT DOCUMENTS

| | | | |
|---|---|---|---|
| CN | 1840347 | A | 10/2006 |
| JP | 2001-146030 | A | 5/2001 |
| JP | 2001-328277 | A | 11/2001 |
| JP | 2004-306466 | A | 11/2004 |
| JP | 2005-22257 | A | 1/2005 |
| JP | 2006-248201 | A | 9/2006 |
| JP | 2006-315302 | A | 11/2006 |
| JP | 2007-15408 | A | 1/2007 |

* cited by examiner

*Primary Examiner* — Matthew Luu
*Assistant Examiner* — Erica Lin
(74) *Attorney, Agent, or Firm* — Sughrue Mion, PLLC

(57) ABSTRACT

A liquid container includes: a bubble trapping section, disposed upstream of the upstream buffer chamber. The bubble trapping section includes: a bubble trapping chamber, adapted to trap bubbles upside by allowing the liquid level to be lowered with reduction in an amount of remaining liquid at a time of consuming the liquid; an inlet, communicating at a vertical upper position of the bubble trapping chamber to introduce the liquid at the time of consuming the liquid; and an outlet, communicating at a vertical lower position of the bubble trapping chamber to discharge the liquid at the time of consuming the liquid.

8 Claims, 15 Drawing Sheets

LIQUID CONTAINER AND METHOD OF MANUFACTURING THE SAME

BACKGROUND

1. Technical Field

The present invention relates to a liquid container suitable for detecting an amount of remaining liquid (ink) in a liquid consuming apparatus such as an inkjet printing apparatus and a method of manufacturing the liquid container.

2. Related Art

As a representative example of a liquid consuming apparatus, there is an inkjet printing apparatus having an inkjet print head for printing an image. Other liquid ejecting apparatuses may include an apparatus having a coloring material ejecting head used for manufacturing a color filter and the like of a liquid crystal display, an apparatus having an electrode material (conductive paste) ejecting head used for forming electrodes of an organic EL display, a field emission display (FED), and the like, an apparatus having a biological organic material ejecting head used for manufacturing a bio chip, and an apparatus having a sample ejecting head as a precise pipette.

In the inkjet printing apparatus as the representative example of the liquid consuming apparatus, an inkjet print head having a pressure generator pressurizing a pressure generating chamber and nozzle orifices ejecting the pressurized ink as ink droplets is mounted on a carriage. By endlessly supplying the ink in an ink container to the print head through a flow channel, a printing operation can be continuously performed. The ink container is constructed as a detachable cartridge that can be replaced by a user when the ink is completely consumed.

There is a method of managing ink consumption by integrating the number of ink droplets emitted from the print head or the amount of ink sucked in maintenance by software or a method of managing when the ink is actually consumed by a predetermined amount by attaching a liquid level detecting electrode to the ink cartridge, as a method of managing the ink consumption of an ink cartridge.

However, the method of managing the ink consumption by integrating the number of ejected ink droplets or the amount of ink by software causes the following problem. The head may eject ink droplets with non-uniformity in weight. The non-uniformity in weight of the ink droplets does not affect the image quality but the ink with a margin is filled in the ink cartridge in consideration of accumulation of errors in ink consumption due to the non-uniformity. Accordingly, there is a problem that the ink corresponding to the margin remains in some apparatuses.

On the other hand, in the method of managing when the ink is consumed by the use of an electrode, since the actual amount of remaining ink can be detected, it is possible to manage the amount of remaining ink with high reliability. However, since the detection of the ink level depends on the conductivity of the ink, the kinds of ink detectable are limited, thereby complicating the sealing structure of the electrode. Since precious metals with excellent conductivity and anti-corrosion are usually used as the material of the electrode, the cost for manufacturing the ink cartridge is enhanced. Since two electrodes should be necessarily formed, the number of manufacturing processes increases, thereby increasing the manufacturing cost.

Therefore, to solve the above-mentioned problems, a piezoelectric device (herein, referred to as a sensor unit) is disclosed in JP-A-2001-146030. The sensor unit monitors the amount of ink remaining in the ink cartridge by the use of the resonance frequency of a residual vibration signal resulting from the residual vibration (free vibration) of a vibrating plate after forcible vibration when the ink remains and does not remain in a sensor cavity opposed to the vibrating plate having a piezoelectric element formed thereon.

In FIG. 8 of JP-A-2006-248201, plural vertical-direction changing portions changing the flow of ink in vertical directions are shown. The space above the vertical-direction changing portions serves as a bubble trapping space.

In FIGS. 9 and 14 of JP-A-2006-315302, a structure supporting a sensor base at three positions of a partition wall and both main case walls thereof is shown. In JP-A-2001-328277, a barrier wall is disposed in the liquid opposed to the sensor, whereby bubbles hardly enter the sensor cavity even when the bubbles are formed in the liquid level in the tank.

Techniques of securing a bypass channel of a liquid by not welding a part of a film covering an opening of a liquid passage and then closing the bypass channel of the liquid by welding the part of the film are disclosed in JP-A-2005-022257 and JP-A-2004-306466.

The technique disclosed in JP-A-2006-248201 employs a specific gravity separation method of trapping bubbles having small specific gravity in the upside by the use of a labyrinth channel on the basis of a difference in specific gravity between the liquid and the bubbles.

Here, as shown in FIG. 8 of JP-A-2006-248201, the ink is introduced from the lower position of the bubble trapping space and the ink is discharged from the lower position of the bubble trapping space. In this case, as described later, when the ink consumption rate is great due to a continuous printing operation and thus the ink flow rate is great, the bubbles in the bubble trapping space are sucked into the ink and discharged along with the ink in the vicinity of the ink end. Then, bubbles are formed in the buffer chamber in the just upstream side of the sensor cavity and the bubbles are detected by the sensor, thereby falsely detecting the ink end.

In the technique disclosed in JP-A-2006-315302, the vibration of the piezoelectric element is absorbed by the main case coming in contact with the sensor base at three positions, thereby making it difficult to satisfactorily guarantee the vibration being detectable by the piezoelectric element. Since the sensor base is positioned in an opening formed in the main case, bubbles may stay in minute gaps around the sensor base at the time of injecting the ink, thereby causing false detection of the ink end. This problem is not prevented even by the use of the barrier wall shown in JP-A-2001-328277. This is because the barrier wall hinders the flow of ink at the time of initially injecting the ink to easily generate bubbles around the sensor base.

SUMMARY

An advantage of some aspects of the invention is that it provides a liquid container that can prevent formation of bubbles in the immediate upstream of a sensor cavity even when the amount of remaining ink decreases, thereby enhancing the liquid detection precision.

Another advantage of some aspects of the invention is that it provides a liquid container that can reduce the false detection by employing a structure for enhancing the amplitude at the time of detecting the liquid and a structure for suppressing bubbles from staying around the sensor base at the time of introducing the liquid.

Another advantage of some aspects of the invention is that it provides a method of manufacturing a liquid container that can deliver bubbles to satisfactorily fill the liquid container with the liquid even when the bubbles are easily gathered due to its structure at the time of filling the liquid container with the liquid.

According to an aspect of the invention, there is provided a liquid container including: a case in which a flow channel of a liquid is exposed from an opening; a sensor base, disposed in the opening of the case to face the flow channel; a sensor chip, including: a piezoelectric element, mounted on a surface opposite to a surface of the sensor base which faces the flow channel; and a sensor cavity, disposed opposite to the piezoelectric element and adapted to receive the liquid as a detection target; a film, adapted to hold the sensor base in the opening and sealing the opening; a partition wall, partitioning the flow channel in the case into an upstream buffer chamber and a downstream buffer chamber; and a bubble trapping section, disposed upstream of the upstream buffer chamber. The bubble trapping section includes: a bubble trapping chamber, adapted to trap bubbles upside by allowing the liquid level to be lowered with reduction in an amount of remaining liquid at a time of consuming the liquid; an inlet, communicating at a vertical upper position of the bubble trapping chamber to introduce the liquid at the time of consuming the liquid; and an outlet, communicating at a vertical lower position of the bubble trapping chamber to discharge the liquid at the time of consuming the liquid.

According to an aspect of the invention, there is also provided a method of manufacturing a liquid container having a tank chamber, first and second communication holes communicating with the tank chamber, and a flow channel communicating with the first communication hole, the method including: welding a film to one surface of the liquid container in which openings communicating with the tank chamber and the flow channel, respectively, are formed; filing the tank chamber with a liquid from the second communication hole disposed in a vertical upper portion of the tank chamber; and delivering bubbles, which are gathered in the vertical upper portion of the tank chamber at a time of filling the tank chamber with the liquid, from the tank chamber to the flow channel through a bypass channel extending from an opening of the tank chamber to an opening of the flow channel through a non-welded portion of the film.

The present disclosure relates to the subject matter contained in Japanese patent application Nos. 2007-269355 filed on Oct. 16, 2007, 2008-75006 filed on Mar. 24, 2008 and 2008-75549 filed on Mar. 24, 2008, which are expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described in detail. The following embodiments do not excessively limit the scope of the invention described in the appended claims and all elements described in the embodiments are not essential to the solving means of the invention.

Ink Cartridge

An ink cartridge (liquid container) to which a liquid detecting device according to an embodiment of the invention is attached will be described now with reference to the accompanying drawings.

Figure 1:
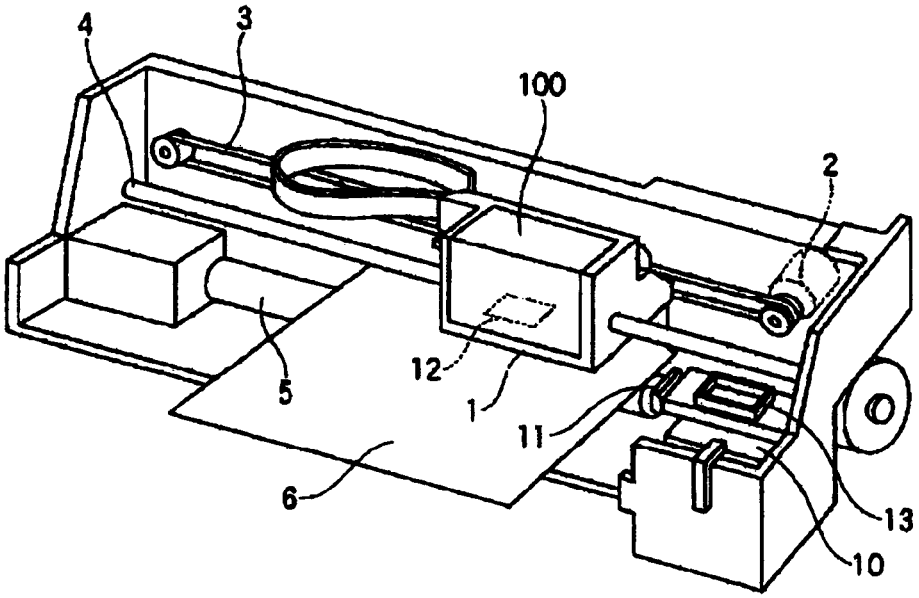
FIG. 1 is a schematic perspective view of an inkjet printer as a liquid consuming apparatus.

FIG. 1 is a diagram schematically illustrating a configuration of an inkjet printing apparatus (liquid consuming apparatus) employing the ink cartridge according to this embodiment. A carriage 1 is guided by a guide member 4 via a timing belt 3 driven by a carriage motor 2 and reciprocates in the axial direction of a platen 5.

An inkjet print head 12 is mounted on a side of the carriage 1 facing a printing sheet 6. An ink cartridge 100 supplying ink (water ink or oil ink) to the print head 12 is demountably mounted on a holder (not shown) disposed in the upper portion of the carriage 1.

A cap member 13 is disposed at a home position (in the right side in FIG. 1) which is a non-printing area of the printing apparatus. The cap member 13 is pressed on a nozzle formation surface of the print head 12 to form a closed space with the nozzle formation surface, when the print head 12 mounted on the carriage 1 moves to the home position. A pump unit 10 giving a negative pressure to the closed space formed by the cap member 13 to perform a cleaning process is disposed below the cap member 13.

In the vicinity of a printing area in the cap member 13, a wiping unit 11 having an elastic plate of rubber is disposed to reciprocate in the horizontal direction about the moving trace of the print head 12. The wiping unit 11 wipes out the nozzle formation surface of the print head 12 as needed when the carriage 1 reciprocates with respect to the cap member 13.

Figure 2:
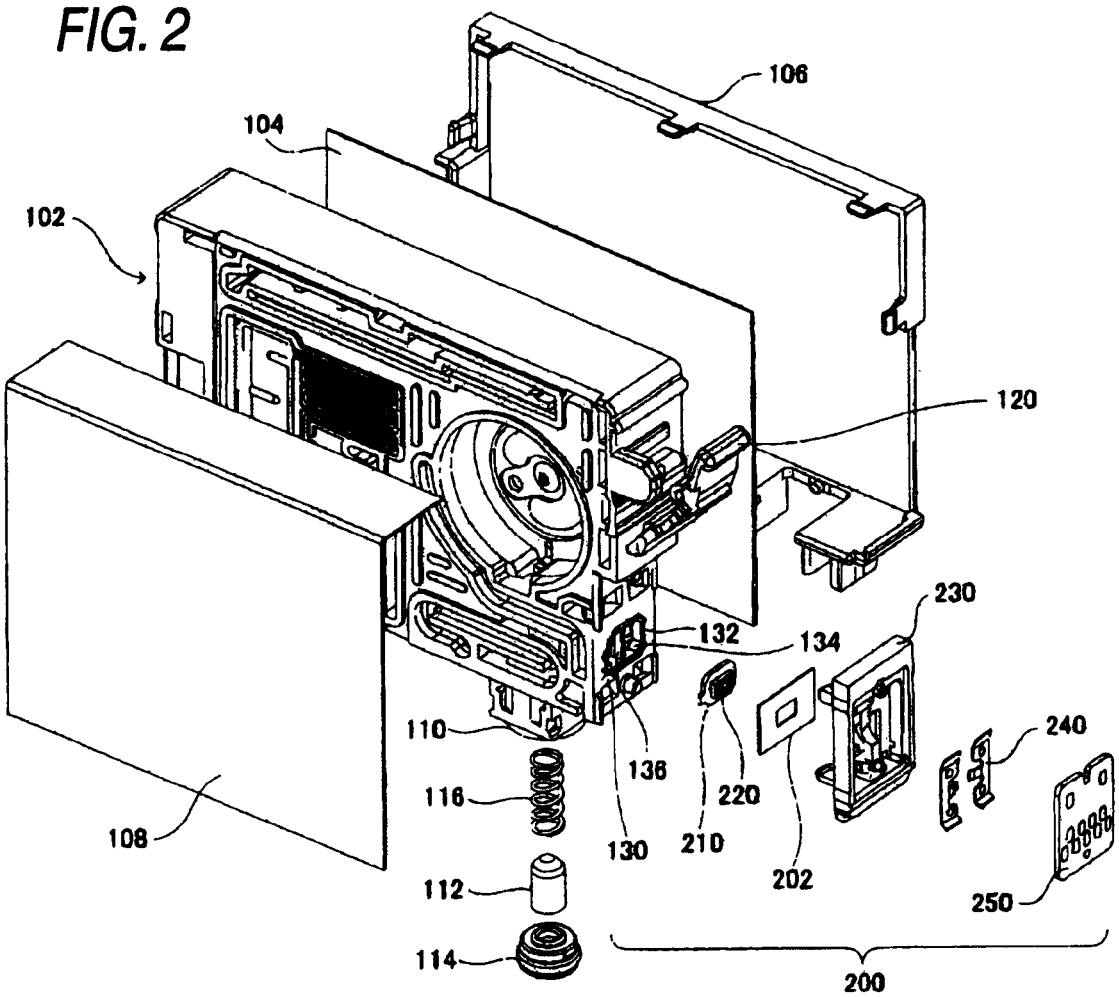
FIG. 2 is an exploded perspective view of an ink cartridge.

FIG. 2 is a perspective view schematically illustrating a configuration of an ink cartridge 100. In FIG. 1, the ink cartridge 100 is disposed to correspond to the vertical direction in the state where the ink cartridge is mounted on the carriage 1. Accordingly, the term "vertical" used in the following description means the vertical direction in the state where the ink cartridge 100 is mounted on the carriage 1.

The ink cartridge 100 includes a film 104 covering the rear surface of the main case 102, a cover member 106 covering the film 104 and the bottom surface of the main case 102, and a film 108 covering the surface and the top surface of the main case 102.

The main case 102 is partitioned by ribs or walls complexly. The main case 102 includes an ink channel section having an ink containing area and an ink delivery channel, an ink-side passage allowing the ink containing area to communicate with the atmospheric air, and an atmospheric communication portion having an atmospheric air valve receiving chamber and an atmospheric air-side passage, detailed description of which are omitted (for example, see JP-A-2007-15408).

The ink delivery channel of the ink channel section finally communicates with an ink supply section 110 and the ink in the ink cartridge 100 is sucked up from the ink supply section 110 for supply by the negative pressure.

An ink supply needle (not shown) of the holder disposed in the carriage 1 is inserted into the ink supply section 110. The ink supply section 110 includes a supply valve 112 that is pressed by the ink supply needle and slides to open its valve, a sealing member 114 formed of an elastic material such as elastomer, which is fitted to the surrounding of the ink supply needle, and an urging member 116 formed of a coil spring to urge the sealing member 114 to the supply valve 112. Theses elements are assembled by fitting the urging member 116, inserting the sealing member 114 to the ink supply section 110, and finally pushing the supply valve 112.

A lever 120 engaging with the holder disposed in the carriage 1 is disposed on one side surface of the main case 102. An opening 130 opened at a position corresponding to the upstream of the ink supply section 110 and the end of the ink delivery channel is formed at a position on one side surface of the main case 102, for example, at a position below the lever 120. A welding rib 132 is formed in the circumferential edge of the opening 130. A partition rib 136 partitions the ink delivery channel 134 facing the opening 130 into an upstream buffer chamber 134*a* and a downstream buffer chamber 134*b* (the reference numerals are omitted in FIG. 2; see FIGS. 8 and 9) is formed.

Ink Detector

Figure 3:
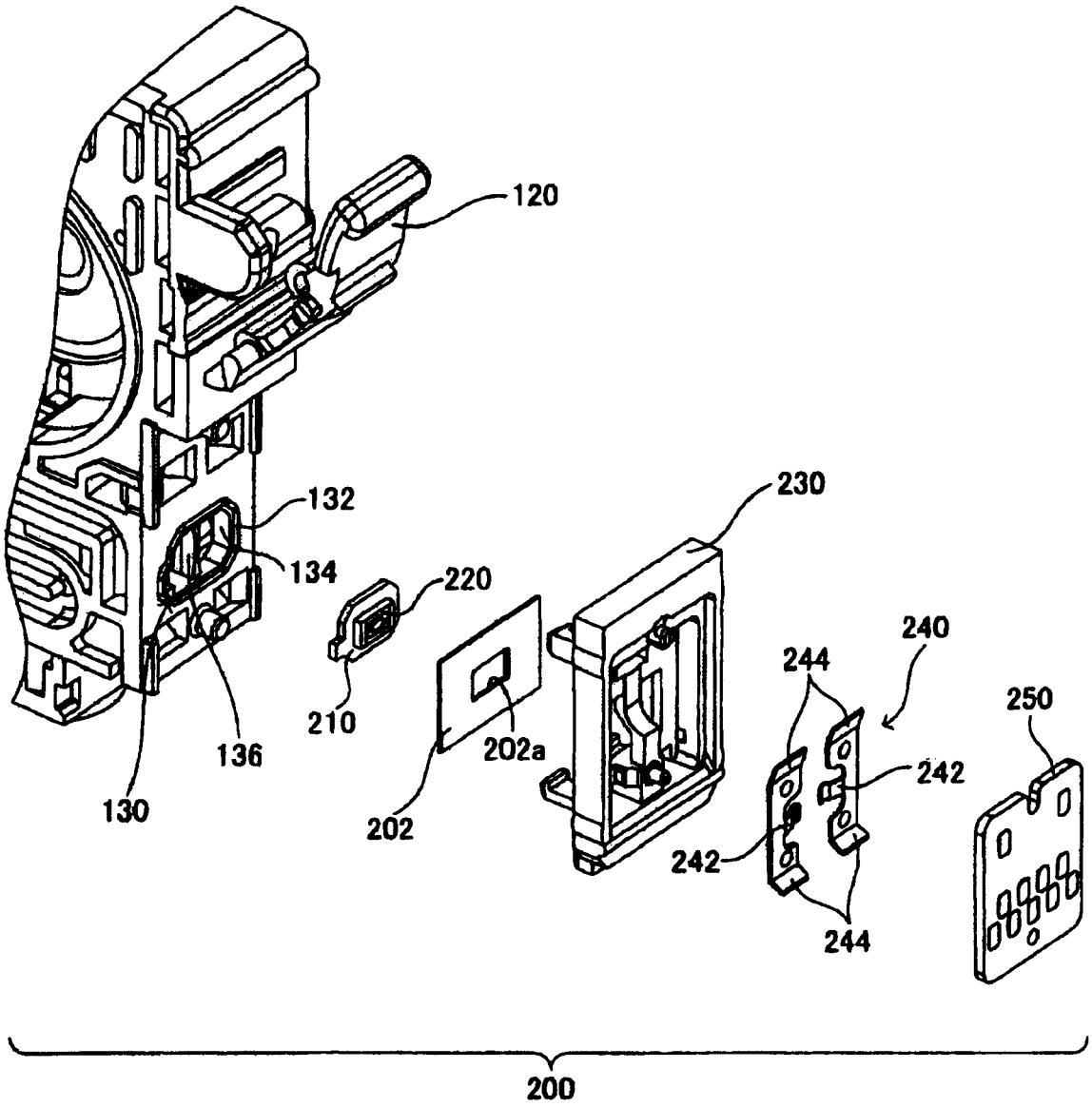
FIG. 3 is an exploded perspective view of an ink detector where a part of FIG. 2 is enlarged.

An ink detector 200 employing the liquid detector according to this embodiment, which is formed by the main case 102, the ink delivery channel 134, and the partition rib 136, will be described now with reference to FIGS. 2 and 3. FIG. 3 is an enlarged view of the ink detector 200 in the ink cartridge 100 shown in FIG. 2.

In FIGS. 2 and 3, the ink detector 200 includes a resin main case 102 in which the ink delivery channel 134 is formed, a metal sensor base 210 disposed in the opening 130 of the main case 102 to face the ink delivery channel 134, a sensor chip 220 mounted on a surface of the sensor base 210 opposite to the surface facing the ink delivery channel 134, a film 202 holding the sensor base 210 in the opening 130 and sealing the opening 130, and a partition wall 136 partitioning the ink delivery channel 134 in the main case 102 into upstream and downstream. The film 202 is bonded to the top surface of the sensor base 210 and is welded to the welding rib 132 around the opening 130.

In FIGS. 2 and 3, the ink detector 200 further includes a pressing cover 230 disposed above the sensor base 210, the sensor chi p220, and the film 202, a relay terminal 240 having terminals 242 electrically connected to the sensor chip 220 through a hole 202*a* formed in the film 202, and a circuit board 250 received in the pressing cover 230 and electrically connected to the terminals 244 of the relay terminal 240. In the liquid container 100 according to this embodiment, the pressing cover 230, the relay terminal 240, and the circuit board 250 are not essential elements.

Upstream Channel Structure of Ink Detector

Before describing in detail the ink detector, the channel structure upstream of the ink delivery channel 134 in the ink detector will be described with reference to FIG. 4.

Figure 4:
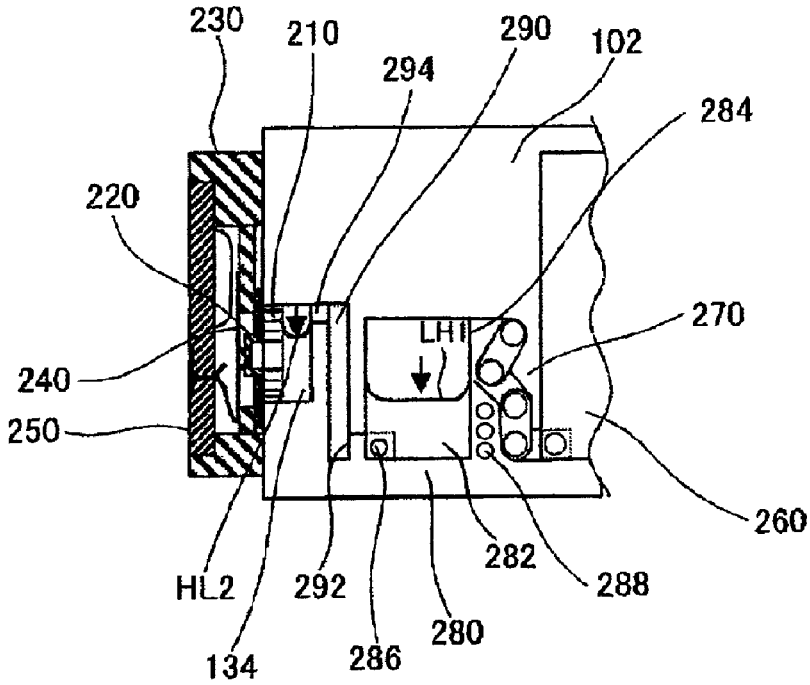
FIG. 4 is a sectional view schematically illustrating a flow channel according to an embodiment of the invention including a bubble trapping chamber on the upstream side in the ink detector.

FIG. 4 is a sectional view illustrating the most downstream portion including the ink detector 200 in the ink container according to this embodiment. In FIG. 4, a tank chamber (liquid containing chamber) 260 which is an ink containing area and a detour channel 270 having a labyrinth shape bent vertically and horizontally as a delivery channel communicating with the tank chamber are shown schematically. For example, a bubble trapping section 280 is disposed at the most downstream end of the detour channel 270. The bubble trapping section 280 communicates with the ink delivery channel 134 of the ink detector 200 through, for example, a communication channel 290.

The bubble trapping section 280 includes a bubble trapping chamber (tank chamber) 282 trapping the bubbles in the upper portion thereof with the lowering of the liquid level LH1 due to the decrease in the amount of remaining ink at the time of consuming the ink, an inlet 284 introducing the ink at a vertical upper position of the bubble trapping chamber 282 at the time of consuming the ink, and an outlet 286 discharging the ink at a vertical lower position of the bubble trapping chamber 282 at the time of consuming the ink.

In this embodiment, the bubble trapping chamber 282 employs the specific gravity separation method of separating the ink and the bubbles by the use of a difference in specific gravity between the ink and the bubbles. The specific gravity separation method is known in a system for continuously supplying a liquid. This embodiment employs a structure for not mixing the bubbles into the ink, particularly, even when the amount of remaining ink decreases.

The bubble trapping chamber 282 traps the bubbles in the upper portion thereof with the lowering of the liquid level LH1 due to the decrease in the amount of remaining liquid. The bubble trapping employs the specific gravity separation method without any change and is not different from that of the bubble trapping chamber used to endlessly supply the liquid.

In the course of trapping the bubbles when the amount of remaining ink decreases, the inlet 284 is located in the vertical upper portion of the bubble trapping chamber 282. Then, the bubbles initially generated from the inlet 284, but when the lower end of the bubble group does not reach the outlet 284, no meniscus is formed in the inlet 284, thereby stopping the generation of the bubbles. At the same time, the bubbles gathered in the upper portion are broken and merged to form a gas space, the liquid level of which is LH1. Then, in the bubble trapping chamber 282, the mixture of the bubbles into the liquid is prevented. When the outlet 286 of the bubble trapping chamber 282 is located at the vertical lower position, only the liquid not containing the bubbles is discharged and thus the bubbles are not mixed in the communication channel 290 and the delivery channel 134 of the ink detector 200 downstream therefrom. Accordingly, the false detection is prevented at the time of detecting the ink end by detecting the bubbles.

Figure 5:
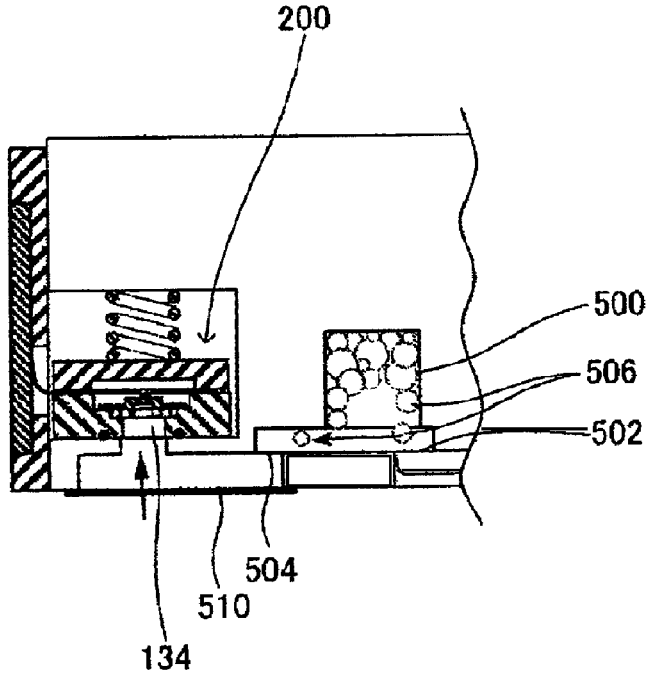
FIG. 5 Related Art
FIG. 5 is a sectional view illustrating a bubble trapping chamber of a comparative example of FIG. 4.

FIG. 5 shows a comparative example of a related art. In the comparative example, the bubble trapping chamber 500 used to endlessly supply the liquid is made to communicate with the delivery channel 134 of the ink detector 200 through the communication channel 510. That is, the inlet 502 and the outlet 504 of the bubble trapping chamber 500 are both located at the vertical lower position in the bubble trapping chamber 500. In the bubble trapping chamber 500, the bubbles having small specific gravity can be trapped in the vertical upper space.

However, in the comparative example, particularly, when the amount of ink consumption per unit time is great, the ink in the bubble trapping chamber 500 is replaced with the bubbles and thus a lot of bubbles may remain in the upstream portion therefrom when the bubbles reach the ink detector 200. When time elapses in this state, the bubbles are finally broken and disappear, but the ink forming the bubbles may serve as the remaining ink and may enter the ink detector 200 at the time of consuming the ink, where the remaining ink may be detected later. In addition, the bubbles 506 in the bubble trapping chamber 500 are involved in the flow of ink and the bubbles are delivered to the delivery channel 134 of the ink detector 200 through the communication channel 510 downstream therefrom. Then, as described later, the bubbles enter the sensor cavity, thereby causing the false detection of the ink end.

Accordingly, in this embodiment shown in FIG. 4, the ink is introduced from the inlet 284 disposed at the upper position of the bubble trapping chamber 282 and the remaining of the bubbles in the ink can be satisfactorily prevented in the bubble trapping chamber 282 during the lowering of the liquid level LH1 due tow the decrease in the amount of remaining ink.

In this embodiment, the bubble trapping chamber 282 may be connected directly to the delivery channel 134, but the communication channel 290 may be disposed downstream of the bubble trapping chamber 282. The communication channel 290 includes a supply hole 292 communicating with the outlet 286 of the bubble trapping chamber 282 at the time of consuming the ink and guides the ink introduced from the vertical lower position to the vertical upper portion. Then, the communication channel 290 introducing the ink from the outlet 294 located at the vertical upper position of the delivery channel 134 (upstream buffer chamber 134*a*) is further provided.

Accordingly, in the vicinity of the ink end after the ink in the bubble trapping chamber 282 is consumed, as shown in FIG. 4, the liquid level HL2 in the delivery channel 134 (upstream buffer chamber 134*a*) is lowered and a meniscus is formed at that time. Therefore, in the delivery channel 134 (upstream buffer chamber 134*a*), the bubbles are removed from the liquid in the course of repeating the destruction and reconstruction of the meniscus. Accordingly, the false detection can be further prevented.

In this embodiment, a liquid containing chamber (tank chamber) 260 disposed upstream of the bubble trapping chamber 282 to contain the ink is opened to the atmospheric air as described above. Then, the space above the meniscus formed in the bubble trapping chamber 282 can be filled with the atmospheric air instead of the consumed ink.

In this embodiment, a detour channel 270 bent in a labyrinth shape is disposed between the bubble trapping chamber 282 and the liquid containing chamber (tank chamber) 260. The detour channel 270 can also trap the bubbles.

In this embodiment, the ink cartridge may be disposed at the time of filling the ink container so that the bubble trapping chamber 282 has a posture vertically reverse to that at the time of consuming the ink. That is, at the time of filling the ink container, the bubble trapping chamber is vertically reverse and the ink is introduced from the outlet 286 located at the vertical upper position. Therefore, the bypass channel 288 opened at the time of filling the ink container to allow the bubble trapping chamber 282 to communicate with the detour channel 270 can be disposed vertically above the bubble trapping chamber 282 at the time of filling the ink container. The bypass channel 288 can deliver the bubbles gathered in the upper portion of the bubble trapping chamber 282 to the detour channel 270 at the time of filling the ink container. Accordingly, it is possible to prevent the bubbles from being mixed into the liquid in the bubble trapping chamber 282. Since the gathering of the bubbles in the bubble trapping chamber 282 can be prevented, the bubble trapping chamber 282 can be filled with the ink. Accordingly, it is possible to prevent the false detection of the ink end due to the mixture of the bubbles even when a lot of ink remains in the bubble trapping chamber 282 of the ink detector 200. The bypass channel 288 is closed at the time of consuming the ink.

Details of Ink Detector

Figure 6:
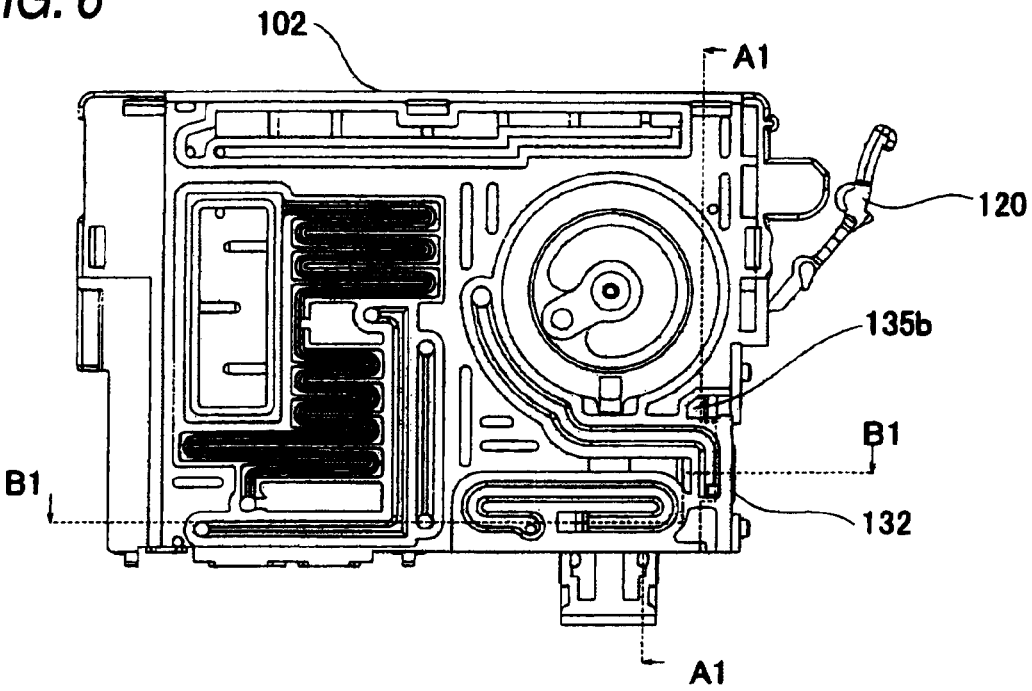
FIG. 6 is a front view of the ink cartridge.
Figure 7:
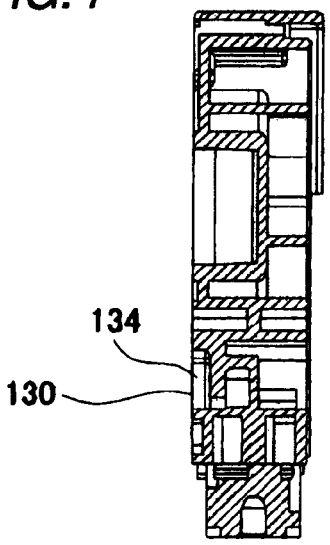
FIG. 7 is a sectional view taken along line A1-A1 of FIG. 6.

Details of the ink detector 200 will be described now with reference to FIGS. 6 to 13. FIG. 6 is a front view of the main case 102. As shown in FIG. 7 which is a sectional view taken along line A1-A1 of FIG. 6, the ink delivery channel 134 is exposed from the opening 130 at the position close to the end before reaching the ink supply section 110 shown in FIG. 1.

Figure 8:
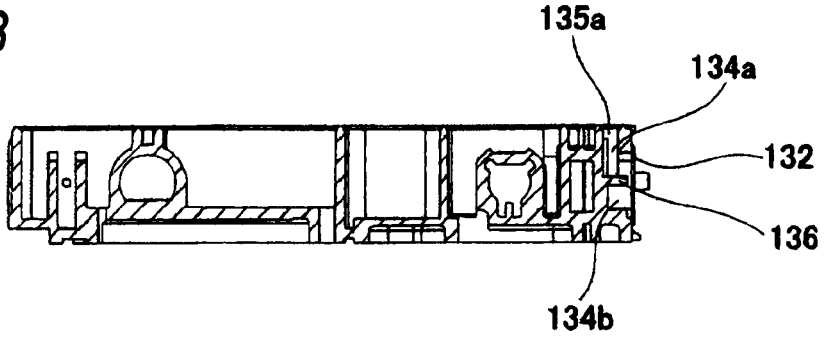
FIG. 8 is a sectional view taken along line B1-B1 of FIG. 6.
Figure 9:
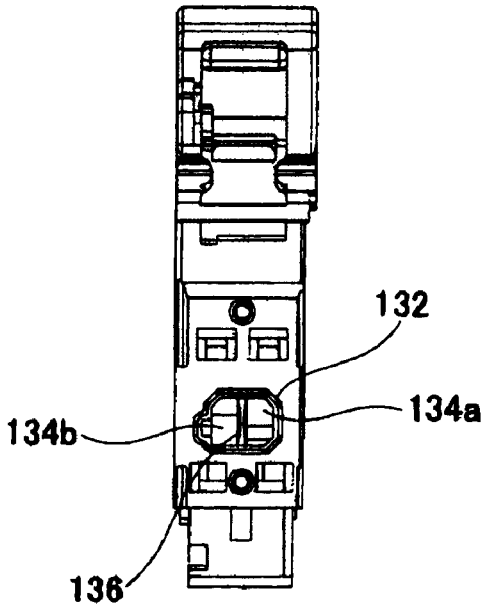
FIG. 9 is a right side view of the ink cartridge.

As shown in FIG. 8 which is a sectional view taken along line B1-B1 of FIG. 6 and FIG. 9 which is a right side view of the ink cartridge 100, the ink delivery channel 134 exposed from the opening 130 is partitioned into the upstream buffer chamber 134*a* and the downstream buffer chamber 134*b* by the partition wall 136. The inlet 135*a* is disposed to face the upstream buffer chamber 134*a* as shown in FIG. 8 and the outlet 135*b* is disposed to face the downstream buffer chamber 134*b* as shown in FIG. 6.

Figure 10:
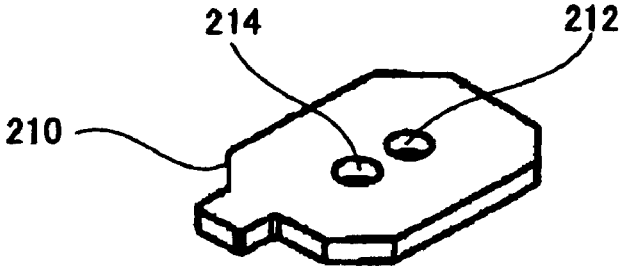
FIG. 10 is a perspective view of a sensor base as viewed from the rear side.

FIG. 10 is a perspective view of the sensor base 210 as viewed from the downside. As shown in FIG. 10, a first hole (supply path) 212 and a second hole (discharge path) 214 penetrating the sensor base 210 in the thickness direction are disposed.

Figure 11:
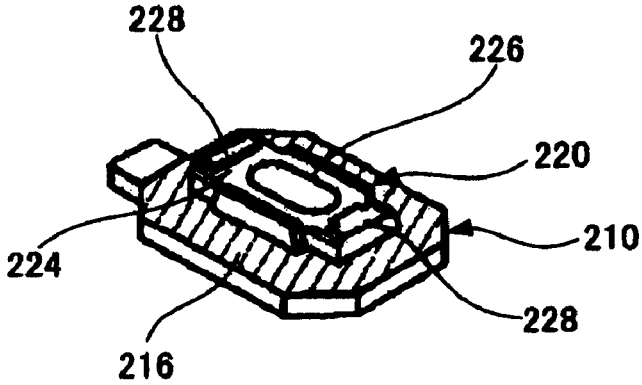
FIG. 11 is a perspective view illustrating a sensor base mounted with a sensor chip as viewed from the outside.
Figure 12:
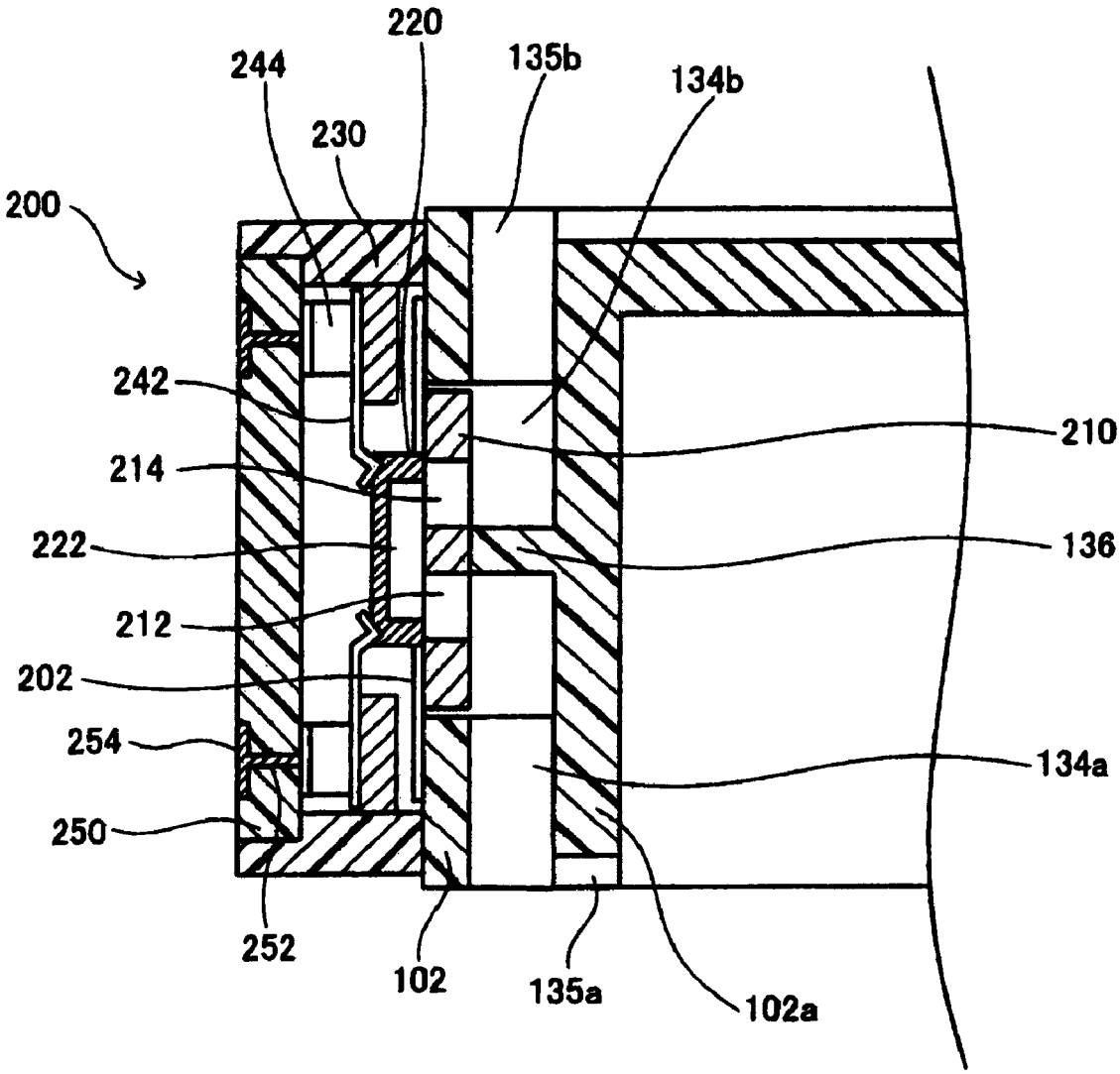
FIG. 12 is a sectional view of an assembled ink detector.
Figure 17:
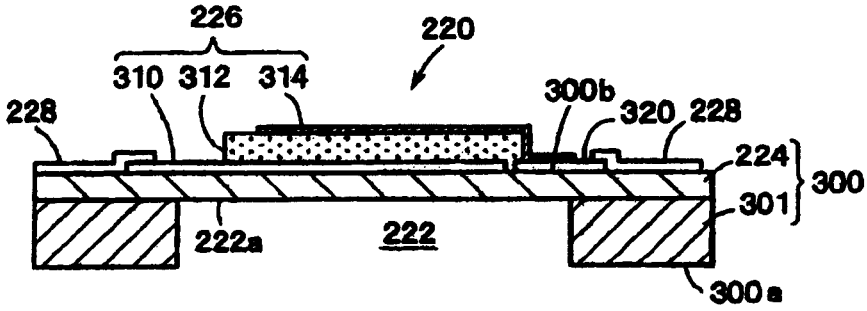
FIG. 17 is a sectional view of the sensor chip.

FIG. 11 is a perspective view of the sensor base 210 mounted with the sensor chip 220 as viewed from the upside. FIG. 12 is a sectional view schematically illustrating a state where the ink detector 200 shown in FIGS. 2 and 3 is assembled. FIG. 17 is a sectional view of the sensor chip.

In FIGS. 12 and 17, the sensor chip 220 has a sensor cavity 222 receiving the ink (liquid) as a detection target and the lower surface of the sensor cavity 222 is opened to receive the ink. The upper surface of the sensor cavity 222 is closed by a vibrating plate 224 as shown in FIGS. 11 and 17. A piezoelectric element 226 is disposed on the upper surface of the vibrating plate 224.

Specifically, as shown in FIG. 17, the sensor chip 220 includes a vibration cavity forming base 300 that is constructed by stacking the vibrating plate 224 on a cavity plate 301 and that has a first surface 300*a* and a second surface 300*b* opposed to each other. The sensor chip 220 further includes the piezoelectric element 226 stacked on the second surface 300*b* of the vibration cavity forming base 300.

In the vibration cavity forming base 300, the cavity 222 having a cylindrical space shape for receiving the medium (ink) as the detection target is opened in the first surface 300*a* and the bottom surface 222*a* of the cavity 222 can be made to vibrate by the vibrating plate 224. In other words, the portion actually vibrating in the vibrating plate 224 is defined in outline by the cavity 222. Electrode terminals 228 and 228 are formed on both sides of the second surface 300*b* of the vibration cavity forming base 300.

A lower electrode 310 is formed on the second surface 300*b* of the vibration cavity forming base 300 and the lower electrode 310 is connected to one electrode terminal 228.

A piezoelectric layer 312 is stacked on the lower electrode 310 and an upper electrode 314 is stacked on the piezoelectric layer 312. The upper electrode 314 is connected to an assistant electrode 320 insulated from the lower electrode 310. The assistant electrode 320 is connected to the other electrode terminal 228.

The piezoelectric element 226 performs the function of determining the ink end on the basis of the difference in electrical characteristics (such as frequency) due to the existence of the ink in the sensor cavity 222. The piezoelectric layer may be formed of piezoelectric zirconate titanate (PZT), piezoelectric lead zirconate titanate (PLZT), or a lead-free piezoelectric film not containing lead.

The sensor chip 220 is fixed monolithically to the sensor base 210 by an adhesive layer 216 by placing the bottom of the chip body on the top center portion of the sensor base 210, and the space between the sensor base 210 and the sensor chip 220 are sealed by the adhesive layer 216.

Detection of Amount of Remaining Ink

As shown in FIG. 12, the ink introduced from the supply hole 135*a* of the ink delivery channel 134 stays in the upstream buffer chamber 134*a* which is one chamber partitioned by the partition wall 136.

The upstream buffer chamber 134*a* communicates with the sensor cavity 222 of the sensor chip 220 through the first hole 212 of the sensor base 210. Accordingly, the ink in the upstream buffer chamber 134*a* is guided to the sensor cavity 222 through the first hole 212 with the supply of the ink. Here, the vibration of the vibrating plate 224 made to vibrate by the piezoelectric element 226 is transmitted to the ink and the existence of the ink is detected on the basis of the frequency of the residual vibration waveform. In the end point where air enters the sensor cavity 222 in addition to the ink, the attenuation of the residual vibration waveform is great and the residual vibration waveform becomes a frequency higher than that of the case where the ink is filled full. By detecting the state, the ink end can be detected.

Specifically, when a voltage is applied to the piezoelectric element 226, the vibrating plate 224 is deformed with the deformation of the piezoelectric element 226. When the application of the voltage is stopped after the piezoelectric element 226 is forcibly deformed, the bending vibration remains in the vibrating plate 224 for a moment. The residual vibration is free vibration of the vibrating plate 224 and the medium in the sensor cavity 222. Accordingly, by setting the voltage applied to the piezoelectric element 226 to a pulse waveform or a rectangular waveform, the resonance state of the vibrating plate 224 and the medium after the application of the voltage can be easily obtained.

The residual vibration is the vibration of the vibrating plate 224 and accompanies the deformation of the piezoelectric element 226. Accordingly, the piezoelectric element 226 generates a back electromotive force with the residual vibration.

As shown in FIG. 12, the circuit board 250 includes an electrode 254 connected to a through-hole 252 penetrating the front and rear surfaces thereof. A signal from the relay terminal 240 contacting the sensor chip 220 is supplied through the through-hole 252 and the electrode 254 and is processed by an analysis circuit (not shown) mounted on the printer body, and the result is transmitted to a semiconductor memory (not shown) mounted on the circuit board 250. That is, the back electromotive force of the piezoelectric element 226 is transmitted to the analysis circuit through the relay terminal 240 and the result is stored in the semiconductor memory.

Since the resonance frequency can be specified by the use of the back electromotive force detected as described above, the existence of the ink in the ink cartridge 100 can be detected on the basis of the resonance frequency. The semiconductor memory stores identification information such as the kind of the ink cartridge 100, information on the color of the ink contained in the ink cartridge 100, and information on the amount of remaining ink.

The ink staying in the sensor cavity 222 is guided to the downstream buffer chamber 134*b* through the second hole 214 of the sensor base 210 with the additional supply of the ink. The ink is supplied along the ink delivery channel 134 through the ink outlet 135*b*, and is finally discharged from the ink cartridge 100 through the ink supply section 110 (see FIG. 2).

Method and Structure for Supporting Sensor Base

When it is intended to fit the sensor base 210, the sensor chip 220, and the film 202 to the opening 130, the following two processes are required. That is, a first process of disposing the metal sensor base 210 mounted with the sensor chip 220 in the opening 130 of the main case 102 having the flow channel 134 formed therein to face the flow channel 134 and a second process of welding the film 202 to the rib 132 around the opening 130 to allow the sensor base 210 to be supported by the main case 102 with the film 202 interposed therebetween are necessary. With the first process and the second process, the sensor cavity 222 formed in the sensor chip 220 communicates with the upstream buffer chamber 134*a* through the first hole 212 formed in the sensor base 210 and communicates with the downstream buffer chamber 134*b* through the second hole 214 formed in the sensor base 210, thereby forming the detection path of the liquid as described above.

In this embodiment, in the first process before welding the film 202, the sensor base 210 is supported by only the partition wall 136 (supporting function using the partition wall). Before the film 202 is welded to the welding rib 132 around the opening 130, the sensor base 210 should be temporarily positioned at a predetermined position of the opening 130. After the sensor base 210 is supported by the film 202 in the second process, the sensor base 210 can come in contact with only the partition wall 136 in the depth direction of the opening 130 (upstream and downstream partitioning function using the partition wall). Since the sensor base 210 is supported by the film 202, the sensor base 210 does not always be in contact with the partition wall 136 but the upstream and downstream partitioning function of the partition wall 136 is always necessary.

Here, as shown in FIG. 12, in this embodiment, a channel wall 102*a* disposed opposite the sensor base 210 is provided to define the ink delivery channel 134. The partition wall 136 is formed monolithically with the channel wall 102*a*. The partition wall 136 is an essential structure for partitioning the ink delivery channel 134 into the upstream buffer chamber 134*a* and the downstream buffer chamber 134*b*. This is because it is not guaranteed that the ink or the bubbles as the medium in the ink delivery channel 134 pass through the sensor cavity 222 when the partition wall 136 is not disposed. When the ink or the bubbles in the ink delivery channel 134 do not pass through the sensor cavity 222, the sensor chip 220 false detects the end point of the ink.

In order to partition the ink delivery channel 134 into the upstream buffer chamber 134*a* and the downstream buffer chamber 134*b*, the partition wall 136 should come in contact with the sensor base 210 or the gap between the sensor base 210 and the partition wall 136 is small so as not to allow the bubbles to pass through the gap. In other words, the flow resistance of the gap should be greater than the flow resistance of the first hole 212, thereby not permitting the passage of the bubbles. This is the inherent function of the partition wall 136.

On the other hand, the partition wall 136 is contacted and supported by the sensor base 210 at the time of fitting the sensor base 210 (first process), thereby preventing the sensor base 210 from falling into the opening 130. That is, in the first process, the partition wall 136 has the function of temporarily supporting the sensor base 210.

After the film 202 is welded to the welding rib 132 around the opening 130 and the sensor base 210 and the sensor chip 220 are attached to the opening 130, the sensor base 210 comes in contact with only the partition wall 136, except for the sensor chip 220 and the film 202. That is, the sensor base 210 can come in contact with only the partition wall 136 in the depth direction of the opening 130.

Accordingly, it is possible to detect the residual vibration waveform by the use of the piezoelectric element 226. In this embodiment, the main case 102 of the ink detector 200 is a part of the main case of the ink cartridge 100 and has a great capacity. In general, the main case 102 is formed of a flexible resin material such as polypropylene and thus the absorption of vibration thereof increases with the increase in capacity.

Here, when the piezoelectric element 226 vibrates, the sensor base 210 mounted with the sensor chip 220 also vibrates in addition to the vibrating plate 224. When the contact area between the sensor base 210 and the main case 102 is great, the vibration of the sensor base 102 is absorbed by the main case 102. In this case, the amplitude of the residual vibration waveform is not enough to detect the residual vibration waveform by the use of the piezoelectric element 226.

In this embodiment, since the sensor base 210 is supported by only the film 202 and the partition wall 136, the vibration wave absorbed by the main case 102 is minimized and thus the amplitude enough to detect the residual vibration by the use of the piezoelectric element 226 is guaranteed.

Figure 13:
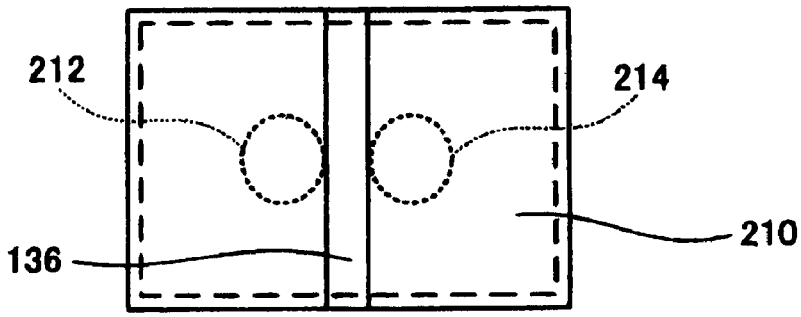
FIG. 13 is a diagram schematically illustrating a positional relation between first and second holes of the sensor base and a partition wall.

FIG. 13 is a sectional view of the partition wall 136 as viewed from the downside. The partition wall 136 is located between the first and second holes 212 and 214 of the sensor base 210. The thickness of the end of the partition wall 136 is the maximum when the partition wall 136 comes in contact with the first and second holes 212 and 214 and should not be set to clog the first and second holes 212 and 214. The clogging enhances the flow resistance of the first and second holes designed with predetermined flow resistance.

Modified Example

Although this embodiment has been described in detail, it should be understood by those skilled in the art that the embodiment can be modified in various forms without departing from the idea and advantages of the invention. Therefore, the following modified examples should be included in the scope of the invention. For example, in the specification or drawings, a term described at least once along with another term having broader meaning or equivalent meaning can be replaced with the another term in any place of the specification or drawings.

Figure 14A:
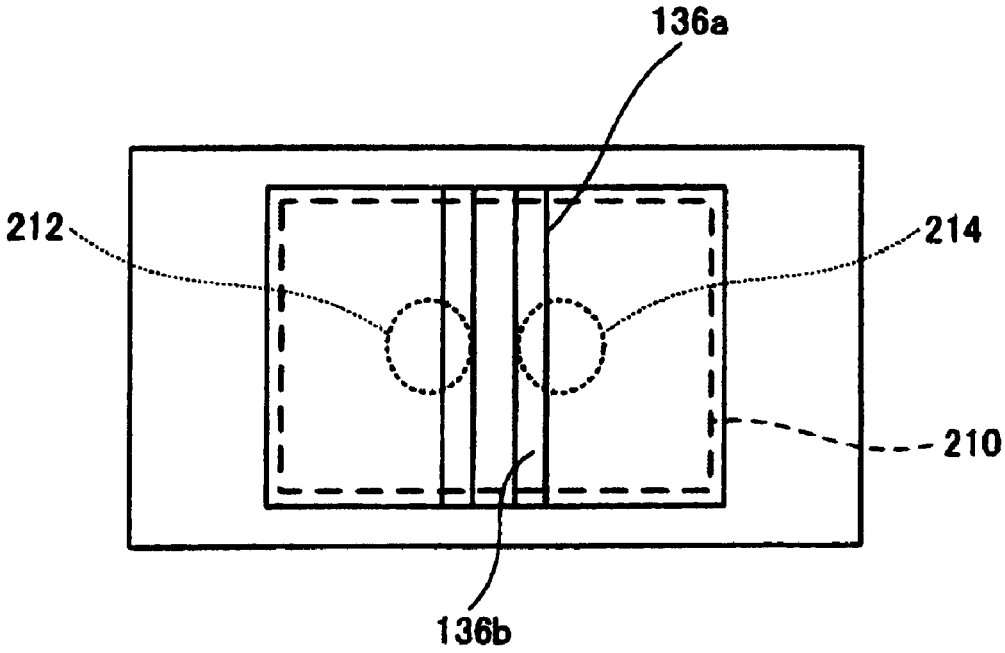
FIGS. 14A and 14B are diagrams illustrating modified examples of the partition wall.
Figure 14B:
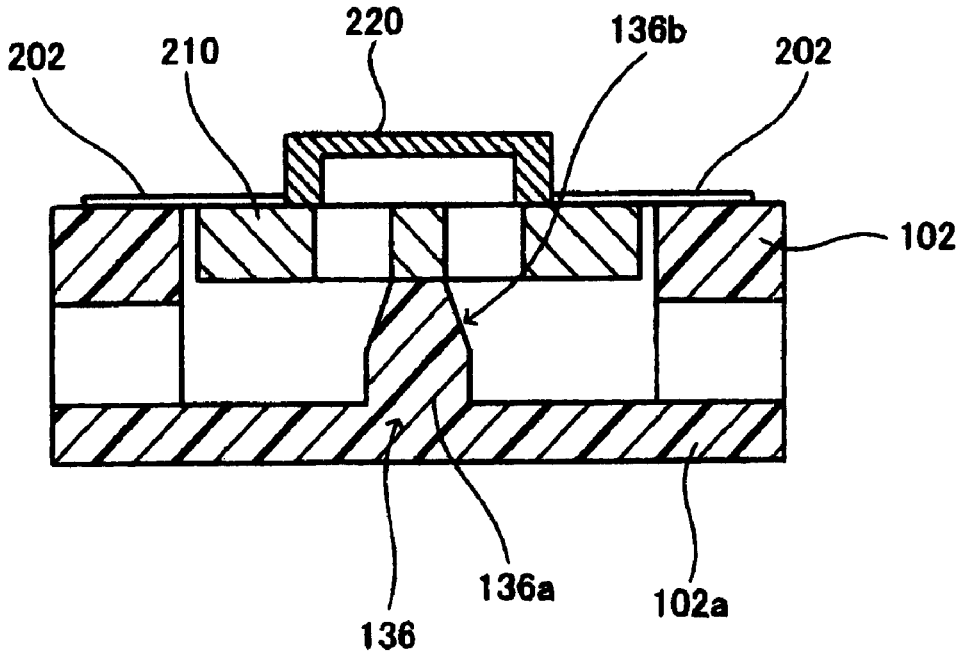

As shown in FIGS. 14A and 14B, the partition wall 136 may have a shape in which the thickness of the free end 136*b* is smaller than that of the base portion 136*a* close to the channel wall 102*a*. That is, even when the base portion 136*a* is broader than the inter-edge distance of the first and second holes 212 and 214, it does not cause any problem so long as the thickness of the free end 136*b* is equal to or less than the inter-edge distance as shown in FIG. 12. This is because it does not enhance the flow resistance of the first and second holes 212 and 214. By broadening the base portion 136*a*, the shaping property for the insertion molding can be improved. As the method of thinning the free end 136*b*, the free end may not be tapered with a slope as shown in FIG. 14B, but may be curved.

Figure 15A:
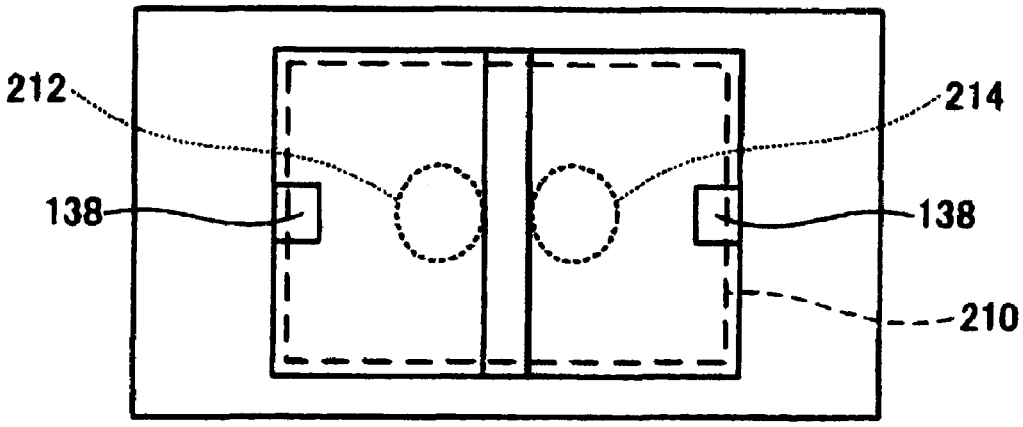
FIGS. 15A and 15B are diagrams illustrating modified examples in which an assistant support portion is provided.
Figure 15B:
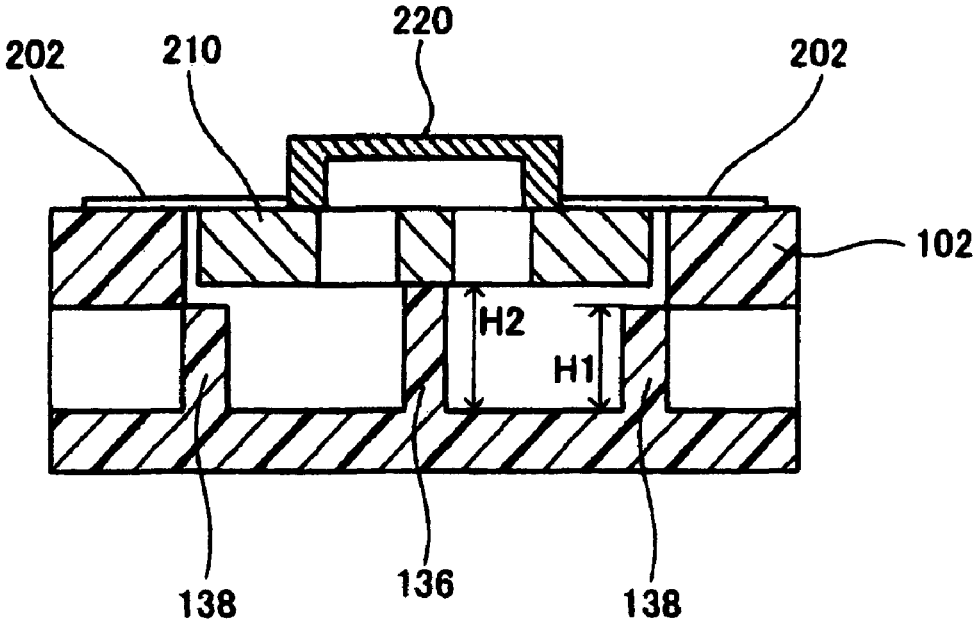

In order to enhance the stability of the attachment of the sensor base 210, the configuration shown in FIGS. 15A and 15B may be employed. That is, an assistant support rib 138 may be provided in addition to the partition wall 136. In FIGS. 15A and 15B, two assistant support ribs 138 contactable with both ends in the longitudinal direction of the sensor base 210 are disposed. However, the height H1 from the channel wall 102*a* to the end of two assistant support ribs 138 is smaller than the height H2 to the end of the partition wall 136.

In the embodiment shown in FIG. 12, since the sensor base 210 is supported by only the partition wall 136 at the time of attachment, the center of the sensor base 210 is supported like a seesaw, which provides bad stability. In the embodiment shown in FIGS. 15A and 15B, even when the sensor base 210 is inclined, the lowered end thereof comes in contact with the assistant support rib 138 and is supported at two points including the partition wall 136, which provides good stability.

However, regarding the assistant support rib 138, since the sensor base 210 is substantially parallel to the channel wall 102*a* after the sensor base 210 is assembled as shown in FIG. 15B, the sensor base 210 does not come in contact with the assistant supporting rib 138. Accordingly, similarly to the embodiment shown in FIG. 12, the amplitude of the residual vibration waveform can be guaranteed greatly.

After the sensor base 210 is assembled, the assistant support rib 138 can prevent the sensor base 210 from being excessively inclined even in the abnormal state where falling impact force acts. Accordingly, it is possible to prevent the sensor base 210 supported by the film 202 from being excessively inclined to tear down the film 202.

Figure 16:
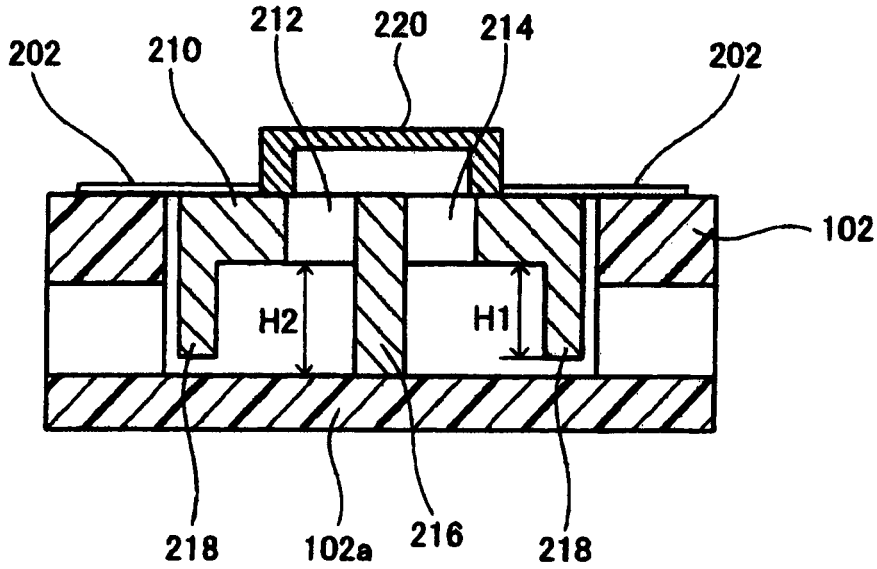
FIG. 16 is a diagram illustrating a modified example where the partition wall and the assistant support portion are provided in the sensor base.

The position of the partition wall 136 is not limited to the channel wall 102*a*. For example, as shown in FIG. 16, a partition wall 216 vertically extending downward from between the first and second holes 212 and 214 of the sensor base 210 may be provided. The partition wall 216 comes in contact with the channel wall 102*a* or is opposed to the channel wall with a slight gap having the flow resistance greater than the flow resistance of the first hole 212. In FIG. 16, an assistant support rib 218 vertically extending downward from both ends in the longitudinal direction of the sensor base 210 is provided. The height H1 from the bottom surface of the sensor base 210 to the end of two assistant support ribs 218 is smaller than the height H2 to the end of the partition wall 216. In this case, the same advantages as the embodiment shown in FIGS. 15A and 15B can be obtained. A partition wall may be disposed in one of the channel wall 102*a* and the sensor base 210 and an assistant support rib may be disposed in the other. In this way, when the partition wall 216 and/or the assistant support ribs 218 are disposed in the sensor base 210, the sensor base 210 is subjected to, for example, a cutting process.

Structure for Preventing False Detection

A structure for preventing the false detection due to the bubbles will be described now with reference to FIGS. 18 to 23.

Figure 18:
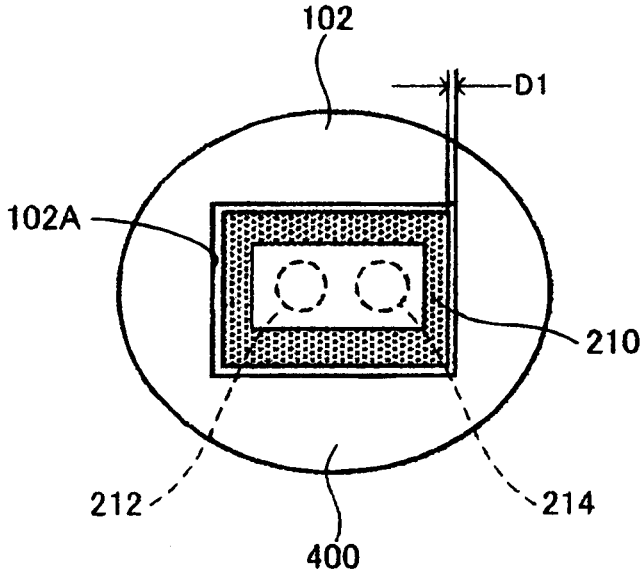
FIG. 18 is a plan view schematically illustrating an attachment structure of the sensor base shown in FIGS. 14B, 15B, and 16 as viewed from the upside of the drawings.

FIG. 18 is a plan view schematically illustrating an attachment structure of the sensor base 210 shown in FIGS. 14B, 15B, and 16 as viewed from the upside of the drawings. However, the film 202 is omitted from FIG. 18. As shown in FIG. 18, in a state where an opening 102A is formed in the main case 102 and the sensor base 210 is disposed in the opening 102A, the sensor base 210 is supported by the film 202. However, in FIG. 18, the film 202 is not shown.

Here, a slight gap D1 is formed between the inner wall of the opening 102A and four sides of the sensor base 210. By setting a margin in design to reduce the gap D1, the sensor base 210 is positioned in the opening 102A.

A problem of the structure shown in FIG. 18 will be described. At the time of filling the main case 102 with the ink, the ink is filled in the main case 102 in a state where the main case is almost in vacuum. At this time, the gap D1 communicates with the upstream buffer chamber 134*a* or the downstream buffer chamber 134*b* shown in FIG. 12 but is narrow enough not to pass the ink. Accordingly, when the ink is fully filled in the upstream buffer chamber 134*a* or the downstream buffer chamber 134*b*, bubbles remain in the gap D1.

Since the film 202 is formed of, for example, polypropylene (PP) and thus has the gas transmitting property, the bubbles grow in a great size by attracting the gas for a long time. The grown bubbles depart from the gap D1 due to the vibration of the piezoelectric element 226 (see FIG. 1) on the sensor base 210 and enter the upstream buffer chamber 134*a* or the downstream buffer chamber 134*b* communicating with the sensor cavity 222 shown in FIG. 12. When the bubbles reach the sensor cavity 222, the ink end is falsely detected in spite of the remaining ink.

Figure 19C:
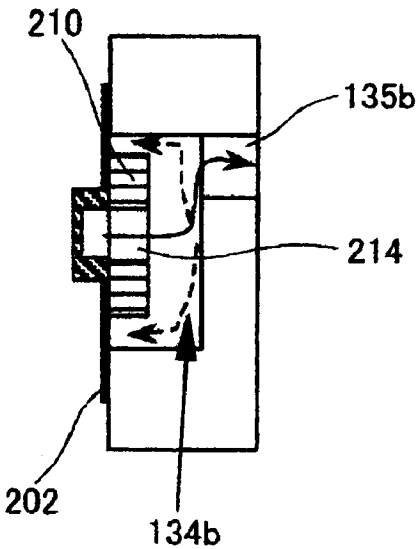
FIG. 19C is a sectional view line B2-B2 of FIG. 19A.
Figure 19B:
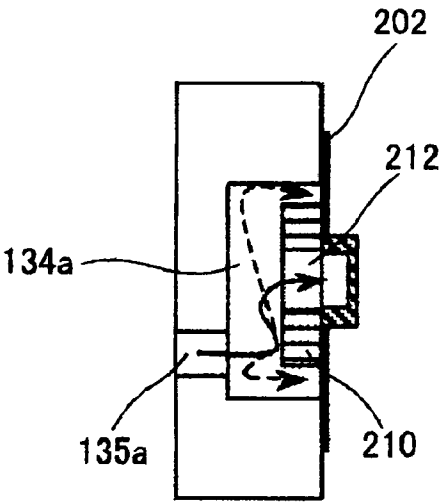
FIG. 19B is a sectional view taken along line A2-A2 of FIG. 19A.
Figure 19A:
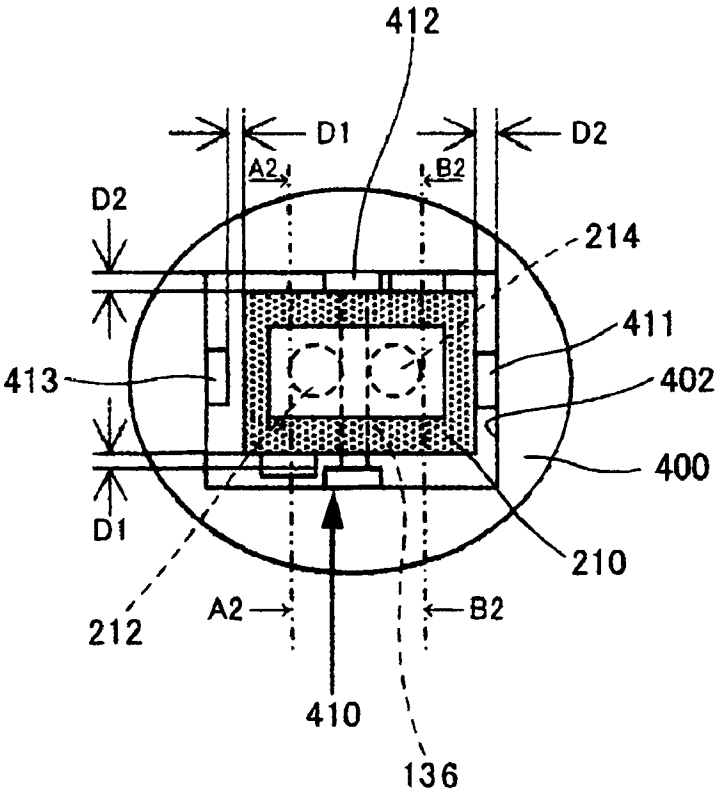
FIG. 19A is a plan view illustrating the state equivalent to that of FIG. 18.

A structure for improving this problem is schematically shown in FIGS. 19A to 19C. FIG. 19A is a plan view of the same state as shown in FIG. 18. FIG. 19B is a sectional view taken along line A2-A2 of FIG. 19A and FIG. 19C is a sectional view taken along line B2-B2 of FIG. 19A.

FIG. 19A shows a principle for solving the problem and it is thus that the sensor base 210 schematically shown is a rectangular shape having four sides. Four positioning portions 410, 411, 412, and 413 protruding to four sides of the sensor base 210 are locally disposed at positions of the opening 402 opposed to four sides of the sensor base 210.

At this time, as shown in FIG. 19A, the gap D1 is formed between the length in the lateral direction of the sensor base 210 and the distance between the positioning portions 410 and 412. Similarly, the gap D1 is formed between the length in the longitudinal direction of the sensor base 210 and the distance between the positioning portions 411 and 413. By defining the gap D1 as a size margin in design, the sensor base 210 can be positioned by the use of four positioning portions 410 to 413. The size of the gap D1 is equal to the size of the gap D1 shown in FIG. 18 and the gap D1 is too narrow to pass the ink.

On the other hand, in the area other than four positioning portions 410, 411, 412, and 413, a gap D2 sufficiently greater than the gap D1 based on the design margin is formed between the wall portion of the opening 402 and four sides of the sensor base 210. The gap D2 forms a part of the flow channel 134 formed by the upstream buffer chamber 134*a* or the downstream buffer chamber 134*b* shown in FIGS. 19B and 19C and partitioned by the partition wall 136 shown in FIG. 19A.

That is, at the time of injecting the ink, the ink is introduced into the sensor cavity 222 through the first hole 212 of the sensor base 210 as indicated by the solid line in FIG. 19B, but the ink introduced from the inlet 135*a* to the upstream buffer chamber 134*a* is diffused by the wall (sensor base 210) located in the traveling direction and also flows in the gap D2 around the sensor base 210 as indicated by the broken line in FIG. 19B. Alternatively, the ink is discharged from the sensor cavity 222 to the outlet 135*b* through the second hole 214 of the sensor base 210 as indicated by the solid line in FIG. 19C, but the ink discharged from the second hole 214 is diffused by the wall (wall of the downstream buffer chamber 134*b*) located in the traveling direction and also flows in the gap D2 around the sensor base 210 as indicated by the broken line in FIG. 19B.

In this way, the gap D2 is filled with the ink and thus the bubbles do not remain. Accordingly, it is possible to prevent the false detection of the ink end.

When it is intended for the ink to easily flow in the gap D2, it is preferable that the inlet 135*a* of the upstream buffer chamber 134*a* is located at a position not opposed to the first hole 212 of the sensor base 210 and the outlet 135*b* of the downstream buffer chamber 134*b* is located at a position not opposed to the second hole 214 of the sensor base 210. Accordingly, as described above, since the wall exists in the traveling direction of the ink introduced or discharged, the ink is diffused and easily flows in the gap D2.

Here, two positioning portions 410 and 412 of four positioning portions exist in an extension line of the partition wall 136 (see FIG. 19A). Otherwise, the flow channel connecting one side of the partition wall 136 to the other side is formed by the gap D2 and thus the ink channel not passing through the sensor cavity 222 is formed.

Figure 20:
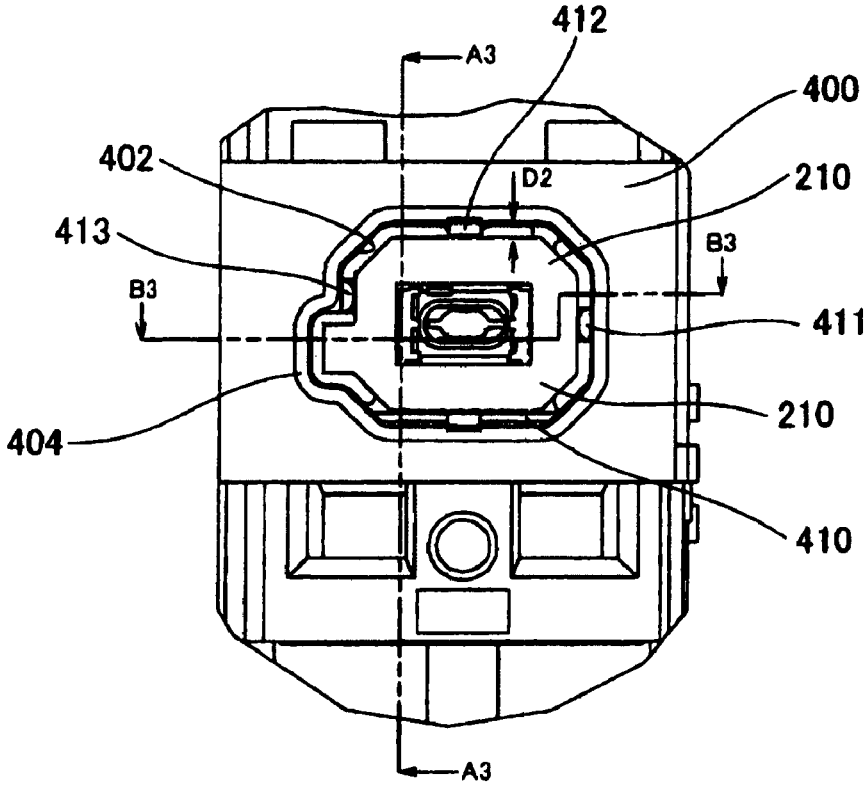
FIG. 20 is a plan view illustrating a specific example of FIGS. 19A to 19C.
Figure 21:
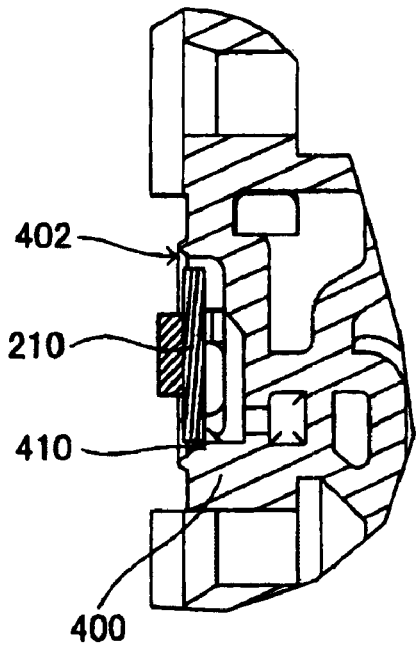
FIG. 21 is a sectional view taken along line A3-A3 of FIG. 20.
Figure 22:
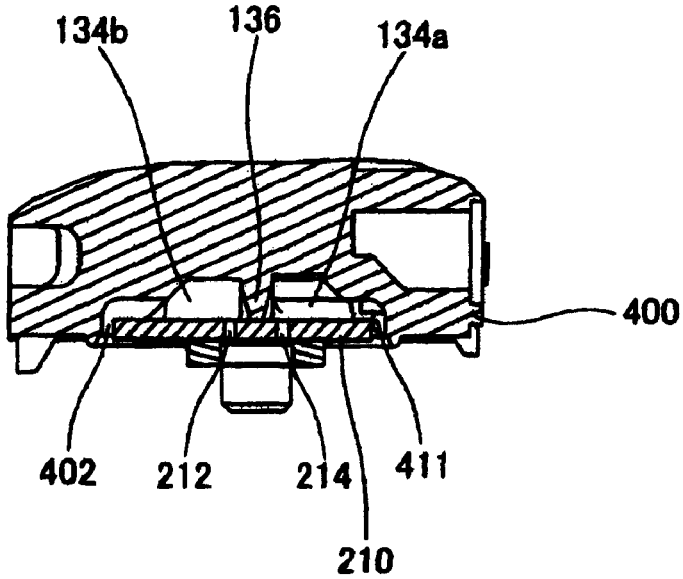
FIG. 22 is a sectional view taken along line B3-B3 of FIG. 20.
Figure 23:
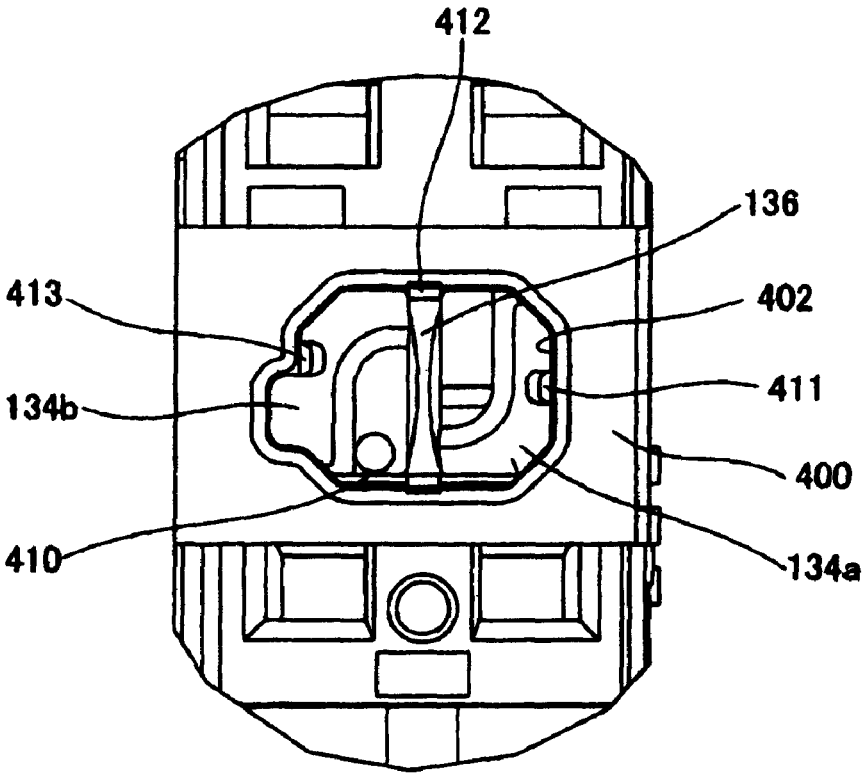
FIG. 23 is a plan view illustrating a main case before the sensor base is mounted thereon.

A more specific example of the example shown in FIGS. 19A to 19C is shown in FIGS. 20 to 23. FIG. 20 is a plan view illustrating a specific example of FIGS. 19A to 19C. FIG. 21 is a sectional view taken along line A3-A3 of FIG. 20. FIG. 22 is a sectional view taken along line B3-B3 of FIG. 20. FIG. 23 is a plan view of the main case 400 before the sensor base 210 is fitted thereto.

As shown in FIG. 20, a ring-shaped welding rib 404 thermally welded to the film 202 (not shown) is formed around the opening 402 of the main case 400. The sensor base 210 has four sides in total, in which two sides are opposed to each other in two axes perpendicular to each other. The sensor base 210 has four sides to be positioned and the shape for connecting the sides is not limited.

As shown in FIGS. 20 to 23, four positioning portions 410, 411, 412, and 413 protruding to four sides of the sensor base 210 are disposed at positions opposed to four sides of the sensor base 210 in the opening 402. The positioning portion 410 has a longitudinal shape along one side, that is, the longitudinal side, of the sensor base 210. The other positioning portions 411 to 413 are locally disposed with respect to the other three sides of the sensor base 210.

By setting the design margin on the gap D1 (omitted in FIGS. 20 and 21) between four sides in total of the sensor base 210, in which two sides are opposed to each other in two axes perpendicular to each other, and four positioning members 410 to 413 opposed to four sides, the sensor base 210 is positioned in the opening 402. By forming at least one positioning portion 410 of four positioning portions in a longitudinal shape along one side, particularly, the longitudinal side, of the sensor base 210, the sensor base 210 can be effectively positioned in the rotation direction thereof. However, it is not preferable in view of the generation of bubbles that a lot of gaps D1 are set, but it is preferable in view of the regulation of rotation that the longitudinal positioning portion is formed along only one side.

In the area other than four positioning portions 410, 411, 412, and 413, the gap D2 sufficiently greater than the gap based on the design margin is formed between the wall portion of the opening 402 and four sides of the sensor base 210. The gap D2 forms a part of the flow channel 134 formed by the upstream buffer chamber 134*a* and the downstream buffer chamber 134*b* partitioned by the partition wall 136.

As described above, the ink is filled in the main case 400 in a state where the main case is almost in vacuum. At this time, the gap D2 communicating with the upstream buffer chamber 134*a* or the downstream buffer chamber 134*b* can form the flow channel of the ink. Accordingly, when the ink is fully filled in the upstream buffer chamber 134*a* or the downstream buffer chamber 134*b*, the gap D2 is filled with the ink and thus bubbles do not remain in the gap D2. Accordingly, it is possible to prevent the false detection of the ink end.

Two opposed positioning portions 410 and 412 of four positioning portions exist in the extension line of the partition wall 136 (see FIG. 23) to prevent the flow channel not passing the sensor cavity 222 from being formed.

Figure 24B:
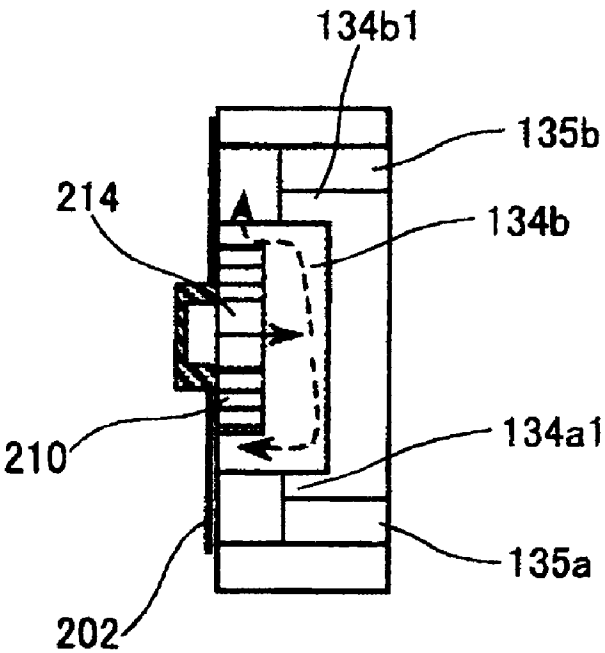
FIG. 24A is a plan view illustrating the state equivalent to those of FIGS. 19A and 20 and FIG. 24B is a sectional view taken along line A4-A4 of FIG. 24A.
Figure 24A:
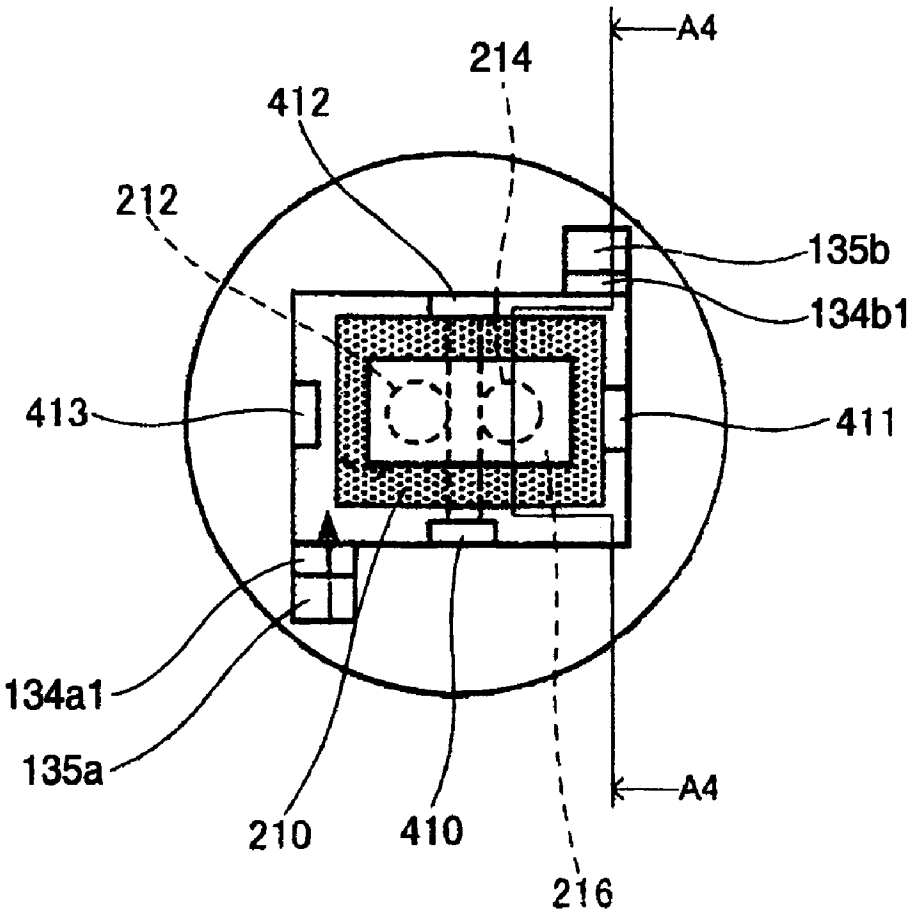

In the example shown in FIGS. 20 to 23, the inlet 135*a* of the upstream buffer chamber 134*a* is located at a position not opposed to the first hole 212 of the sensor base 210 and the outlet 135*b* of the downstream buffer chamber 134*b* is located at a position not opposed to the second hole 214 of the sensor base 210. The positions of the inlet 135*a* and the outlet 135*b* may be set as shown in FIGS. 24A and 24B. FIG. 24A is a plan view illustrating the state equivalent to that of FIG. 19A and FIG. 24B is a sectional view taken along line A4-A4 of FIG. 24A.

In the example shown in FIGS. 24A and 24B, the inlet 135*a* disposed in the upstream buffer chamber 134*a* and the outlet 135*b* disposed in the downstream buffer chamber 134*b* are both disposed at positions opposed to the gap D2 of the opening 402. In this case, it is preferable that a partition wall 134*a*1 partitioning the inlet 135*a* and the upstream buffer chamber 134*a* and a partition wall 134*b*1 partitioning the outlet 135*b* and the downstream buffer chamber 134*b* are provided.

The ink introduced from the inlet 135*a* travels straightly and flows in the gap D2. Preferably, the ink is guided by the partitioning wall 134*a*1 to flow in the gap D2. Similarly, the ink discharged from the second hole 216 of the sensor base 210 is diffused by the downstream buffer chamber 134*b* to flow in the gap D2. Preferably, the ink is guided by the partition wall 134*b*1 to flow in the gap D2.

Details of Bypass Channel

Figure 25:
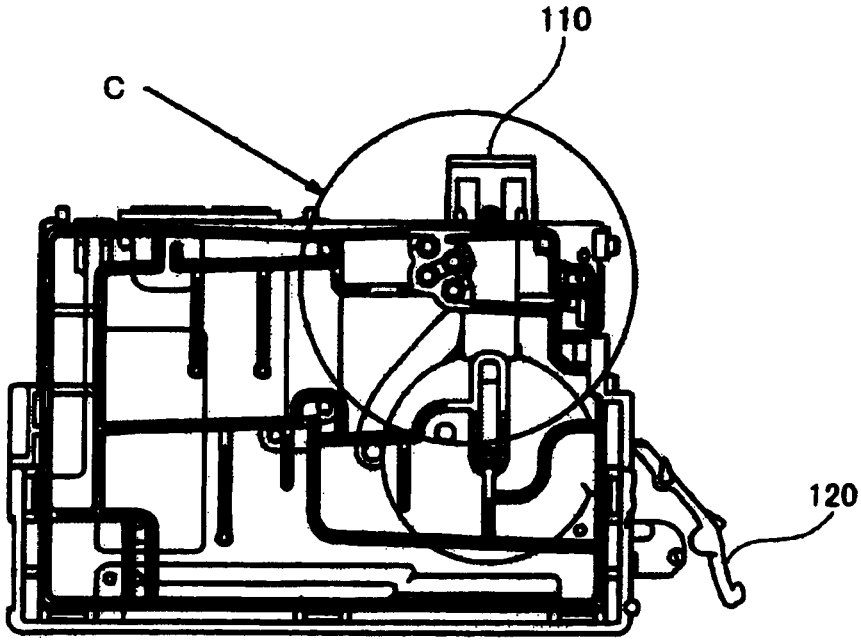
FIG. 25 is a view of the case body shown in FIG. 2 as viewed from the film side.
Figure 26:
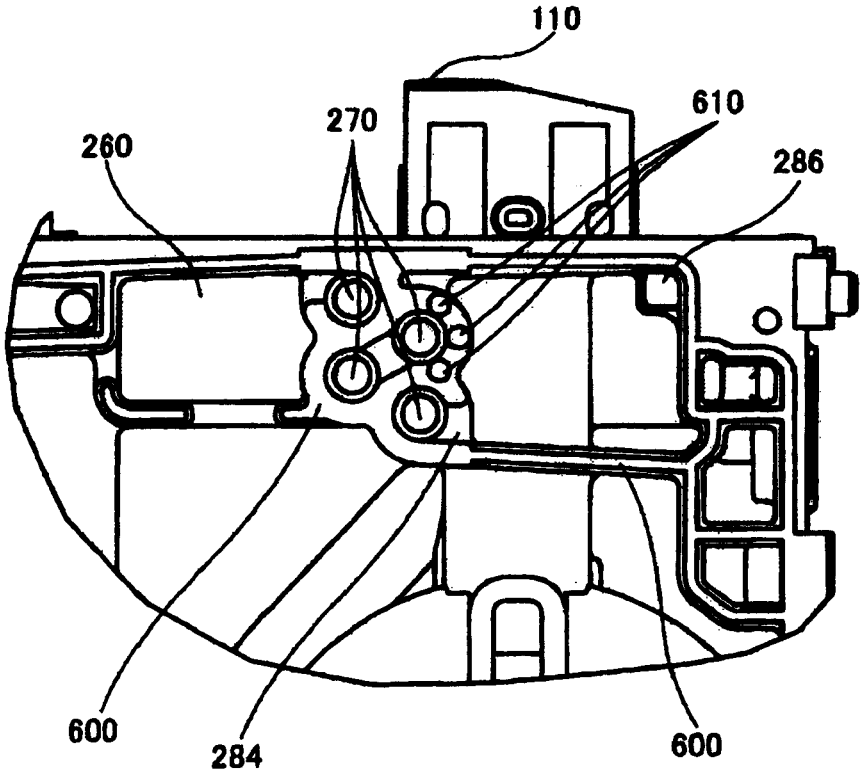
FIG. 26 is an enlarged plan view of part C in FIG. 25.
Figure 27:
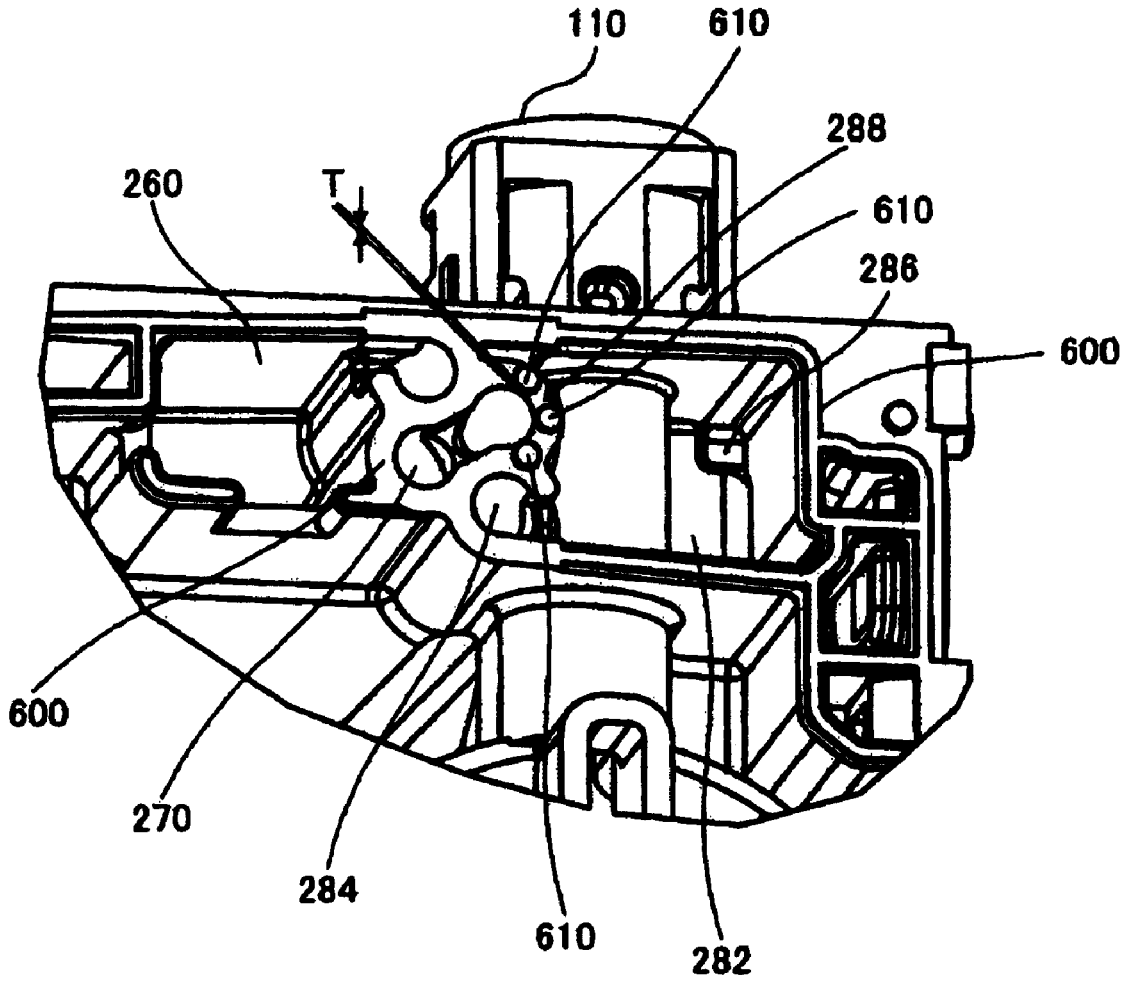
FIG. 27 is an enlarged perspective view of part C in FIG. 25.

The details of the bypass channel 288 for removing the bubbles described with reference to FIG. 4 will be described with reference to FIGS. 25 to 27. FIG. 25 is a view of the case body 102 shown in FIG. 2 as viewed from the film 104. FIG. 26 is an enlarged plan view of part C in FIG. 25. FIG. 27 is an enlarged perspective view of part C.

In FIGS. 26 and 27, the case body 102 is provided with a tank chamber 260 as a liquid containing chamber, a detour channel 270, and a bubble trapping chamber 282, which have openings opened on the attachment surface side of the film 104 (FIG. 2), respectively. The film 104 is thermally welded to a sealing surface 600 close to the surface of the case body 102 to which the film 104 is attached. Accordingly, the openings of the tank chamber 260, the detour channel 270, and the bubble trapping chamber 282 are liquid-tightly sealed.

Here, FIGS. 25 to 26 show a filling posture at the time of filling the ink cartridge 100 with the ink, instead of the posture shown in FIG. 2 at the time of consuming (using) the ink. That is, the posture of the ink cartridge 100 is vertically reverse at the time of consuming the ink and at the time of filling the ink cartridge 100. At the time of filling the ink cartridge, the ink is filled from the ink supply section 110 with the ink supply section 110 facing the upside.

At the time of filling the ink cartridge, the ink is introduced into the bubble trapping chamber 282 from the outlet 286 disposed in the vertical upper portion of the bubble trapping chamber 282. At this time, the ink is discharged to the detour channel 270 from the inlet 284 disposed in the vertical lower portion of the bubble trapping chamber 282. That is, at the time of filling the ink cartridge, the vertical position is reverse to that at the time of consuming (using) the ink, and the inlet 284 serves as the outlet and the outlet 286 serves as the inlet. That is, the functions are also reversed. Hereinafter, in order to avoid the confusion in title and function at the time of consuming (using) the ink and at the time of filling the ink cartridge, the inlet 284 and the outlet 286 are referred to as a first communication hole 284 and a second communication hole 286, respectively.

In the posture shown in FIG. 2 at the time of consuming (using) the ink, the positional relation of the first and second communication holes 284 and 286 relative to the bubble trapping chamber 282 is useful, in that the bubbles can be trapped.

However, at the time of filling the ink cartridge when the positional relation is reversed and the inlet and the outlet are also reversed, the positional relation of the first and second communication holes 284 and 286 relative to the bubble trapping chamber 282 is not desirable. The second communication hole 286 shown in FIG. 27 is located in the vertical upper portion of the bubble trapping chamber 282 and serves as the inlet at the time of filling the ink cartridge. On the other hand, the first communication hole 284 shown in FIG. 27 is located in the vertical lower portion of the bubble trapping chamber 282 and serves as the outlet at the time of filling the ink cartridge. When the ink is charged from the second communication hole 286 located in the vertical upper portion of the bubble trapping chamber 282 and the ink is discharged from the first communication hole 284 located in the vertical upper portion of the bubble trapping chamber 282, a stagnation portion where the bubbles are gathered can be easily formed in the vertical upper portion of the bubble trapping chamber 282. When there is no place to which the bubbles are delivered, the bubble trapping chamber 282 is not filled with the ink. In addition, the bubbles remaining in the bubble trapping chamber 282 move to the ink detector 200 at the time of consuming the ink and enters the sensor cavity 222, thereby causing the false detection of the ink end.

Therefore, a bypass channel 288 for pulling out the bubbles is provided. The bypass channel 288 is similar to that of JP-A-2005-022257 and JP-A-2004-306466 in that a part of the film 104 is not welded, but is different from that of JP-A-2005-022257 and JP-A-2004-306466 in installation position and usage or object.

As shown in FIG. 27, the bypass channel 288 is guaranteed by one or more protrusion 610, for example, three protrusions 610 in this embodiment, protruding from the sealing surface 600 by a height T. When the protrusions 610 are not welded to the film 104, a gap formed by the protrusions 610 is guaranteed between the sealing surface 600 formed on one surface of the case body 102 and the film 104. The gap serves as the bypass channel 288. More specifically, the opening of the detour channel 270 is made to communicate with the opening of the bubble trapping chamber 282 through the non-welded portion (particularly, between two protrusions 610) of the film 104 from the opening of the bubble trapping chamber 282, thereby forming the bypass channel 288.

The bypass channel 288 may be formed by one or more grooves depressed from the sealing surface 600 by a predetermined depth. When the grooves are not welded to the film 104, a gap is guaranteed between the bottom of the groove and the film 104.

Method of Manufacturing Liquid Container

A method of manufacturing the ink cartridge 100 (liquid container) including the case body having the structure shown in FIGS. 25 to 27 has the following processes. First, the film 104 shown in FIG. 2 is welded to the sealing surface 600 formed on one surface of the case body 102 having the openings communicating with the bubble trapping chamber 282 and the detour channel, respectively. At this time, as described above, the protrusions 610 or the grooves are used as the non-welded portions to which the film 104 is not welded, so as to guarantee the bypass channel 288. The welding work is preferably is performed with the ink cartridge 100 placed in the depressurized atmosphere. In this case, useless air does not enter the ink channel in the ink cartridge 100.

Then, the posture at the time of consuming the ink (see FIGS. 2, 3, and 6) is a posture where the ink cartridge 100 is vertically reversed (see FIGS. 25 to 27). In this posture, the ink is supplied from the ink supply hole 110. At the time of filling the ink cartridge, the ink is introduced into the bubble trapping chamber from the second communication hole 286 disposed in the vertical upper portion of the bubble trapping chamber 282. The introduction of the ink is smoothly carried out by depressurizing the ink channel, in addition to the ink supply pressure. The filling of the ink cartridge may be carried out while discharging the air from an opening (not shown) more downstream of the detour channel 270 for depressurization. The ink in the bubble trapping chamber 282 is supplied to the detour channel 270 or the tank chamber 260 downstream therefrom through the first communication hole 284 located in the vertical lower portion of the bubble trapping chamber 282.

At the time of filling the ink cartridge, the bubbles gathered in the vertical upper portion of the bubble trapping chamber 282 is delivered from the bubble trapping chamber 282 to the detour channel 270 through the bypass channel 288 extending from the opening of the bubble trapping chamber 282 to the opening of the detour channel 270 through the non-welded portions of the film 104. The bubbles are discharged to the outside from an end opening opened to the atmospheric air. When the air is discharged from the opening downstream of the detour channel 270 for depressurization, the bubbles are forcibly discharged from the ink cartridge 100.

After finishing the ink filling process, the non-welded portions of the film 104 are welded to close the bypass channel 288. The bypass channel 288 is necessary only at the time of filling the ink cartridge, but not necessary at the time of consuming the ink.

The method of manufacturing the liquid container is not limited to the ink cartridge 100 shown in FIGS. 25 to 27, and the application of the liquid container is not limited to the ink cartridge of the inkjet printing apparatus. The invention may be applied to a variety of liquid consuming apparatuses having a liquid ejecting head for ejecting minute ink droplets.

Specific examples of the liquid consuming apparatuses may include an apparatus having a coloring material ejecting head used for manufacturing a color filter of a liquid crystal display and the like, an apparatus having an electrode material (conductive paste) ejecting head used for forming electrodes of an organic EL display, a field emission display (FED), and the like, an apparatus having a biological organic material ejecting head used for manufacturing a bio chip, an apparatus having a sample ejecting head as a precise pipette, and a printing apparatus or a micro dispenser.

The liquid container according to the embodiment of the invention is not limited to the on-carriage type ink cartridge, but may be a sub tank not mounted on the carriage or an off-carriage type ink cartridge.

In the above-mentioned embodiments, the case body of the liquid detector is also used as the case body of the liquid container and the sealing rubber or spring described in JP-A-2006-248201 is excluded, but the invention is not limited to the configuration. The liquid detector can be configured as a unit independent of the case body of the liquid container. In this case, the sealing rubber or spring may not be excluded, but it can contribute to suppressing the absorption of vibration in the unit case in minimum and guaranteeing the amplitude of the detected waveform greatly, even when the unit case increases in size.

In the above-mentioned embodiment, the liquid ejecting apparatus may be embodied in a so-called full-line type (line head type) printer in which the whole shape of the print head 19 corresponds to the length in the width direction (lateral direction) of a printing sheet (not shown) in the direction intersecting the transport direction (longitudinal direction) of the printing sheet (not shown).

In the above-mentioned embodiment, the liquid ejecting apparatus is embodied in the inkjet printer 11, but not limited to the inkjet printer. The invention may be embodied in a liquid ejecting apparatus spraying or ejecting a liquid (including a liquid material in which functional material particles are dispersed or mixed in a liquid and a fluid material such as gel) other than the ink. Examples thereof include a liquid material ejecting apparatus ejecting a liquid material including in a dispersed or dissolved type a material such as electrode material or coloring material (pixel material) used for manufacturing a liquid crystal display, an electroluminescence (EL) display, or a surface emission display, a liquid ejecting apparatus ejecting a biological organic material used for manufacturing a bio chip, and a liquid ejecting apparatus ejecting a liquid as a sample in a precise pipette. Examples thereof can also include a liquid ejecting apparatus ejecting lubricant to a precise machine such as a watch or camera with a pin point, a liquid ejecting apparatus ejecting transparent resin liquid such as UV-curable resin to a substrate to form minute semi-spherical lenses (optical lenses) used in optical communication devices, a liquid ejecting apparatus ejecting etchant such as acid or alkali to etch a substrate and the like, and a fluid material ejecting apparatus ejecting a fluid material such as gel (for example, physical gel). The invention can be applied to at least one kind of the above-mentioned liquid ejecting apparatuses. In this specification, the "liquid" does not include a liquid containing only gas, and examples of the liquid include a liquid material and a fluid material, in addition to inorganic solvent, organic solvent, solution, liquid-phase resin, and liquid-phase metal (metal solution).

The above-mentioned manufacturing method may be applied to a liquid container having a tank chamber containing a liquid, not the liquid container in which the bubble trapping chamber 282 is filled with the liquid. That is, the invention is not limited to trapping the bubbles at the time of consuming the liquid as described above. There may be a need for removing the bubbles staying at the time of filling the liquid container and filling the tank chamber with the liquid without trapping the bubbles.

In other words, in the method of manufacturing a liquid container according to the embodiment of the invention, the posture for use and the posture for filling may not be necessarily reverse. In some applications, there may be a need for a structure not requiring the consumption of liquid or for allowing the first and second communication holes 284 and 286 in the tank chamber to have the same positional relation as described above for the reason other than the bubble trapping. The detour channel 270 is not essential, but a flow channel connected to the first communication hole 284 may be used.

For example, there may be a liquid container as a kind of buffer in which a liquid always flows in one direction at the time of filling and consuming. In this case, since the bubbles should be removed from the tank chamber instead of the bubble trapping chamber 282, it is not necessary to close the bypass channel 288 after filling the liquid container.

What is claimed is:

1. A liquid container comprising:

a case in which a flow channel of a liquid is exposed from an opening;

a sensor base, disposed in the opening of the case to face the flow channel;

a sensor chip, including: a piezoelectric element, mounted on a surface opposite to a surface of the sensor base which faces the flow channel; and a sensor cavity, disposed opposite to the piezoelectric element and adapted to receive the liquid as a detection target;

a film, adapted to hold the sensor base in the opening and sealing the opening;

a partition wall, partitioning the flow channel in the case into an upstream buffer chamber and a downstream buffer chamber; and a bubble trapping section, disposed upstream of the upstream buffer chamber, wherein the bubble trapping section includes: a bubble trapping chamber, adapted to trap bubbles upside by allowing the liquid level to be lowered with reduction in an amount of remaining liquid at a time of consuming the liquid; an inlet, communicating at a vertical upper position of the bubble trapping chamber to introduce the liquid at the time of consuming the liquid; and an outlet, communicating at a vertical lower position of the bubble trapping chamber to discharge the liquid at the time of consuming the liquid.

2. The liquid container according to claim 1, wherein a communication channel, guiding the liquid from the outlet of the bubble trapping chamber to a vertical upper portion thereof at the time of consuming the liquid, and introducing the liquid into the upstream buffer chamber from a vertical upper position of the upstream buffer chamber, is provided between the upstream buffer chamber and the bubble trapping chamber.

3. The liquid container according to claim 1, wherein a liquid containing chamber, disposed more upstream than the bubble trapping chamber, and adapted to contain the liquid, is exposed to air.

4. The liquid container according to claim 3, wherein a detour channel, bent in a labyrinth shape, is disposed between the bubble trapping chamber and the liquid containing chamber.

5. The liquid container according to claim 4, wherein a posture of the liquid container at a time of filling with the liquid is vertically reverse of a posture of the liquid container at the time of consuming the liquid, the liquid is introduced from the outlet to the bubble trapping chamber at the time of filling with the liquid, a bypass channel, allowing the bubble trapping chamber to communicate with the detour channel, is disposed at an upper position than the inlet of the bubble trapping chamber in the posture of the liquid container at the time of filling with the liquid, and the bypass channel is opened at the time of filling with the liquid and is closed at the time of consuming the liquid.

6. The liquid container according to claim 1, wherein the sensor base includes: a first hole, guiding the liquid from upstream in the flow channel to the sensor cavity; and a second hole, guiding the liquid from the sensor cavity to downstream in the flow channel, and the sensor base is contactable with the case through only the partition wall located between the first and second holes of the sensor base in a depth direction of the opening.

7. The liquid container according to claim 6, wherein the sensor base has a shape having four sides in which two sides face each other in two axial directions perpendicular to each other, at least four positioning portions, protruding to the four sides of the sensor base, are disposed at positions of the opening of the case which are opposed to the four sides of the sensor base, and in an area other than the at least four positioning portions, gaps between a wall portion of the opening and the four sides of the sensor base form a part of the flow channel on the upstream or the downstream.

8. The liquid container according to claim 7, wherein two of the at least four positioning portions are disposed in an extension line of the partition wall.

* * * * *